US012077363B2

(12) United States Patent
Conway et al.

(10) Patent No.: US 12,077,363 B2
(45) Date of Patent: Sep. 3, 2024

(54) METHOD AND SYSTEM FOR STORING AND/OR TRANSPORTING TEMPERATURE-SENSITIVE MATERIALS

(71) Applicant: Cold Chain Technologies, LLC, Franklin, MA (US)

(72) Inventors: Heather M. Conway, Franklin, MA (US); Raymond A. McCarthy, Pawtucket, RI (US); Geoffrey Kaiser, Westborough, MA (US); James Nilsen, Mays Landing, NJ (US); Henry Melchor, Woonsocket, RI (US); Dawn E. Smith, Hopkinton, MA (US)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 370 days.

(21) Appl. No.: 17/675,251

(22) Filed: Feb. 18, 2022

(65) Prior Publication Data

US 2022/0267081 A1 Aug. 25, 2022

Related U.S. Application Data

(60) Provisional application No. 63/151,146, filed on Feb. 19, 2021.

(51) Int. Cl.
*B65D 81/38* (2006.01)
*B65B 5/04* (2006.01)
(Continued)

(52) U.S. Cl.
CPC ..... *B65D 81/3823* (2013.01); *B65B 5/04* (2013.01); *B65B 55/00* (2013.01); *B65D 77/06* (2013.01);
(Continued)

(58) Field of Classification Search
CPC ..... B65D 81/3823; B65D 81/18; B65D 81/3818; B65D 81/3825; B65D 77/06; B65B 5/04; B65B 55/00
See application file for complete search history.

(56) References Cited

U.S. PATENT DOCUMENTS 2,528,715 A 11/1950 Wagner
4,682,708 A 7/1987 Pool
(Continued)

FOREIGN PATENT DOCUMENTS

GB 2566792 A * 3/2019 ..... A61M 39/10

OTHER PUBLICATIONS

WSFA 12 News Staff web page entitled "2 trays of Covid-19 vaccines sent to Alabama returned due to temperature drop," (2020); https://www.wsfa.com/2020/12/16/trays-covid-vaccines-sent-alabama-returned-due-temperature-drop/, accessed Feb. 6, 2024.
(Continued)

*Primary Examiner* — Emmanuel E Duke
(74) *Attorney, Agent, or Firm* — KRIEGSMAN & KRIEGSMAN

(57) ABSTRACT

Method and system for storing and/or transporting temperature-sensitive materials. In one embodiment, the system is designed for use as a dry ice shipper and includes an outer box, a vacuum insulated panel (VIP) base assembly, a VIP lid assembly, and a gas flow director. The VIP base assembly is positioned within the outer box and includes five VIPs arranged to form a container having a bottom, four sides, and an open top. The VIP lid assembly, which may be coupled to a top closure flap of the outer box, includes a VIP dimensioned to close the open top of the VIP base assembly. The gas flow director, which may comprise a bag having an opening at its top end, may be positioned within the outer box and may be used to receive the VIP base assembly. The
(Continued)

gas flow director inhibits convective gas flow that promotes excessive dry ice sublimation.

30 Claims, 12 Drawing Sheets

(51) Int. Cl.
*B65B 55/00* (2006.01)
*B65D 77/06* (2006.01)
*B65D 81/18* (2006.01)

(52) U.S. Cl.
CPC ..... *B65D 81/18* (2013.01); *B65D 81/3818* (2013.01)

(56) References Cited

U.S. PATENT DOCUMENTS

| | | | |
|---|---|---|---|
| 6,868,982 | B2 | 3/2005 | Gordon |
| 6,875,486 | B2 | 4/2005 | Miller |
| 7,140,768 | B2 | 11/2006 | Prabhakar |
| 7,624,873 | B2 | 12/2009 | Tennant et al. |
| 8,250,882 | B2 | 8/2012 | Mustafa et al. |
| 8,499,533 | B2 | 8/2013 | Emond et al. |
| 8,580,369 | B2 | 11/2013 | Emond et al. |
| 9,045,278 | B2 | 6/2015 | Mustafa et al. |
| 9,180,998 | B2 | 11/2015 | Banks et al. |
| 9,556,373 | B2 | 1/2017 | Formato et al. |
| 9,598,622 | B2 | 3/2017 | Formato et al. |
| 9,689,602 | B2 | 6/2017 | Emond et al. |
| 9,994,385 | B2 | 6/2018 | Dudi et al. |
| 10,077,389 | B2 | 9/2018 | Formato et al. |
| 10,583,978 | B2 | 3/2020 | Longley et al. |
| 10,604,326 | B2 | 3/2020 | Longley et al. |
| 10,661,969 | B2 | 5/2020 | Pranadi et al. |
| 10,766,685 | B2 | 9/2020 | Kuhn et al. |
| 10,829,675 | B2 | 11/2020 | Formato et al. |
| 11,137,190 | B2 | 10/2021 | Martino |
| 11,340,005 | B2 | 5/2022 | Nilsen et al. |
| 2005/0178142 | A1 | 8/2005 | Perry et al. |
| 2005/0189404 | A1 | 9/2005 | Xiaohai et al. |
| 2007/0051782 | A1 | 3/2007 | Lantz |
| 2013/0228583 | A1 | 9/2013 | Mayer |
| 2014/0059978 | A1 | 3/2014 | Bolejack et al. |
| 2015/0251758 | A1 | 9/2015 | Vandyke et al. |
| 2015/0285548 | A1 | 10/2015 | Emond et al. |
| 2016/0297606 | A1 | 10/2016 | Roger et al. |
| 2017/0245486 | A1 | 8/2017 | Larson et al. |
| 2018/0100682 | A1 | 4/2018 | Nilsen et al. |
| 2018/0134427 | A1 | 5/2018 | Fallgren |
| 2018/0194535 | A1 | 7/2018 | Collison |
| 2018/0328644 | A1 | 11/2018 | Rizzo et al. |
| 2018/0353379 | A1 | 12/2018 | Chou et al. |
| 2019/0210790 | A1 | 7/2019 | Rizzo et al. |
| 2020/0002075 | A1 | 1/2020 | Lee et al. |
| 2020/0047993 | A1 | 2/2020 | Brabbs et al. |
| 2020/0231362 | A1 | 7/2020 | Kulangara et al. |
| 2020/0307896 | A1 | 10/2020 | Pranadi et al. |
| 2020/0324959 | A1 | 10/2020 | Longley et al. |
| 2020/0331686 | A1 | 10/2020 | Longley et al. |
| 2020/0346840 | A1 | 11/2020 | Munie et al. |
| 2021/0016955 | A1 | 1/2021 | Morine et al. |
| 2021/0024270 | A1 | 1/2021 | Mirzaee Kakhki |
| 2021/0070539 | A1 | 3/2021 | Chasteen et al. |
| 2021/0292630 | A1 | 9/2021 | Formato et al. |
| 2021/0300665 | A1 | 9/2021 | Melchor |
| 2021/0331834 | A1 | 10/2021 | Longley et al. |
| 2022/0002070 | A1 | 1/2022 | Moghaddas et al. |
| 2022/0194682 | A1 | 6/2022 | Michel et al. |
| 2022/0265514 | A1 | 8/2022 | Blezard et al. |
| 2022/0267657 | A1 | 8/2022 | Blezard et al. |
| 2023/0227236 | A1 | 7/2023 | Nilsen et al. |

OTHER PUBLICATIONS

Biocair, Inc. web page entitled "What causes some dry ice shipments to reach -90.C?" (2017); https://www.biocair. com/latest/news/what-causes-some-dry-ice-shipments-to-reach-90-c, accessed Feb. 7, 2024.
Web page for TTx Thermal Inserts, The Illuminate Group, Tampa, Florida; https://theilluminategroup.com/products/ttx-thermal-packages/, accessed Feb. 7, 2024.
"Packaging Perishable Shipments," FedEx Corporation, Memphis, TN (2019).
Web page entitled "How to ship perishables," FedEx Corporation, Memphis, TN; https://www.fedex.com/en-us/shipping/how-to-ship-perishables.html, accessed Feb. 7, 2024.
Web page entitled "How Do I Ship Dry Ice," ShipStation, Austin, TX (2022); https://www.shipstation.com/blog/how-do-i-ship-dry-ice/, accessed Feb. 7, 2024.
Web page for Sub-Zero Ice Services, Miami, FL; https://subzeroiceservices.com/, accessed Feb. 7, 2024.
Web page for CrystalandCory.com; https://crystalandcomp.com/nutrisystem-frozen-food-delivery/, accessed Feb. 7, 2024.
Web page entitled "What Format of Dry Ice Does Your Home Delivery Logistics Need?"; https://www.just-food.com/contractors/cleaning-products-hygiene/cold-jet/pressreleases/format-dry-ice/, accessed Feb. 7, 2024.
International Search Report mailed May 24, 2022, in PCT Application No. PCT/US22/17019, the corresponding PCT application to the subject application.
Written Opinion mailed May 24, 2022, in PCT Application No. PCT/US22/17019, the corresponding PCT application to the subject application.
Mei et al., "Impact of Excessive Sublimation Cooling on the Internal Temperature of Passive Shippers Cooled by Dry Ice," PDA Journal of Pharmaceutical Science and Technology, 74(1):49-57 (2019).
"Evertemp Urethane Insulated Shipping Containers," coldice.com (2015); https://www.coldice.com/insulated_shipping_containers/.
Product Catalog for Polar Tech Industries, Inc., Genoa, IL (2011).
Chern et al., "Root Cause for Near -90°C Excursions in Passive Shippers with Dry Ice as the Coolant," Amgen, IQPC Chicago (2017).
U.S. Appl. No. 17/585,139, inventors James Nilsen et al., filed Jan. 26, 2022 (available in USPTO's IFW system).
U.S. Appl. No. 17/842,544, inventors Anthony Rizzo et al., filed Jun. 16, 2022 (available in USPTO's IFW system).
U.S. Appl. No. 16/246,435, inventors James Robert Chasteen et al., filed Jan. 11, 2019 (available in USPTO's IFW system).
U.S. Appl. No. 17/700,149, inventors TzeHo Lee et al., filed Mar. 21, 2022 (available in USPTO's IFW system).
U.S. Appl. No. 16/827,086, inventors Dawn E. Smith et al., filed Mar. 23, 2020 (available in USPTO's IFW system).
U.S. Appl. No. 17/687,382, inventors James R. Chasteen et al., filed Mar. 4, 2022 (available in USPTO's IFW system).
U.S. Appl. No. 17/726,318, inventors Henry Melchor et al., filed Apr. 21, 2022 (available in USPTO's IFW system).
U.S. Appl. No. 17/891,631, inventors Heather M. Conway et al., filed Aug. 19, 2022 (available in USPTO's IFW system).
U.S. Appl. No. 17/668,569, inventors William C. Blezard et al., filed Feb. 10, 2022 (available in USPTO's IFW system).
U.S. Appl. No. 17/668,610 inventors William C. Blezard et al., filed Feb. 10, 2022 (available in USPTO's IFW system).
U.S. Appl. No. 17/508,418 inventors William C. Blezard et al., filed Oct. 22, 2021 (available in USPTO's IFW system).
U.S. Appl. No. 17/508,447 inventors William C. Blezard et al., filed Oct. 22, 2021 (available in USPTO's IFW system).

* cited by examiner

METHOD AND SYSTEM FOR STORING AND/OR TRANSPORTING TEMPERATURE-SENSITIVE MATERIALS

CROSS-REFERENCE TO RELATED APPLICATIONS

The present application claims the benefit under 35 U.S.C. 119(e) of U.S. Provisional Patent Application No. 63/151,146, inventors Heather M. Conway et al., filed Feb. 19, 2021, the disclosure of which is incorporated herein by reference.

BACKGROUND OF THE INVENTION

The present invention relates generally to methods and systems for storing and/or transporting temperature-sensitive materials and relates more particularly to a novel method and system for storing and/or transporting temperature-sensitive materials.

Various articles of commerce, such as, but not limited to, many types of pharmaceuticals, biological materials, medical devices, foods, and beverages, must be maintained within a desired temperature range during transportation and/or storage in order to prevent spoilage. One way in which such temperature maintenance may be achieved is by transporting and/or storing such articles or materials inside an active temperature-control device that is designed to provide an environment in which the article may be held within the desired temperature range. Examples of an active temperature-control device include an electrically-powered refrigerator, an electrically-powered freezer, or the like. However, as can be appreciated, active temperature-control devices add considerable expense to transportation and/or storage costs.

Another way in which such temperature maintenance may be achieved is by placing the temperature-sensitive article within an insulated container that also contains one or more passive temperature-control members, examples of which include the following: ice packs, gel packs, dry ice, loose pieces of frozen water (i.e., ice), combinations of the foregoing, or the like. The combination of an insulated container and one or more passive temperature-control members disposed therewithin is sometimes referred to herein as a passive temperature-control device, a passive temperature-control system, or a passive thermal system. (In some cases, the term "shipper" is used to refer to a passive thermal system; in other cases, the term "shipper" is used to refer to the aforementioned system minus its passive temperature-control member(s).) Often, in such a passive thermal system, the temperature-sensitive article is placed within a product box (sometimes alternatively referred to as "a payload box"), which, in turn, is positioned within the insulated container. Such a product box may be made of, for example, corrugated cardboard or the like and is often a six-sided rectangular structure having a top, a bottom, and four sides.

Typically, the type of passive temperature-control member that is used in a passive thermal system is based, at least in part, on the temperature range at which one wishes to maintain the temperature-sensitive article in question. For example, when it is desired to maintain the article at a temperature near 0° C., one may choose to use a frozen ice pack or loose pieces of ice as the passive temperature-control member. On the other hand, when it is desired to maintain the article within a much colder temperature range, such as a temperature range of about −90° C. to −60° C., one may choose to use dry ice (i.e., frozen carbon dioxide) as the passive temperature-control member.

When frozen water is used as a passive temperature-control member, it functions by consuming thermal energy (i.e., heat) from its environment. If such frozen water is initially cooled or preconditioned to a temperature below 0° C., as the frozen water starts to consume thermal energy from its environment, the temperature of the frozen water rises until the temperature of the frozen water reaches 0° C. At that point, as the frozen water continues to consume thermal energy from its environment, the frozen water changes phase from a solid to a liquid (i.e., the frozen water melts)—all while remaining at a temperature of 0° C. The melting frozen water remains at a temperature of 0° C. (i.e., the solid/liquid phase change temperature of water at standard pressure) until all of the ice has melted.

Dry ice behaves differently than water. More specifically, instead of transitioning from a solid to a liquid after consuming the requisite amount of thermal energy from its environment, dry ice typically undergoes a transition from a solid to a gas (i.e., sublimation). The sublimation of dry ice typically occurs at a temperature of approximately −78° C. under standard pressure. Those who design and use passive thermal systems often assume that passive temperature-control systems that rely on dry ice are able to consistently maintain an internal temperature that is at the dry ice sublimation temperature of −78° C. In practice, however, this is often not the case. For example, turbulent air conditions present within the insulated container may accelerate the sublimation process, which is endothermic, causing temperatures to be obtained within the insulated container that are much lower than −78° C. for a certain period of time. See Mei et al., "Impact of Excessive Sublimation Cooling on the Internal Temperature of Passive Shippers Cooled by Dry Ice," *PDA Journal of Pharmaceutical Science and Technology,* 74(1): 49-57 (2019) (hereinafter referred to as "Mei"), which is incorporated herein by reference. The aforementioned phenomenon of accelerated sublimation resulting in container temperatures lower than the phase transition temperature is sometimes referred to herein as "supercooling." As will become apparent below, supercooling may be undesirable if it results in a payload being exposed to a temperature that is lower than the minimum temperature to which the payload should be exposed. The accelerated loss of dry ice associated with supercooling may also undesirably shorten the duration at which the passive thermal system may maintain the payload within the desired temperature range.

Also, as noted above, carbon dioxide gas is produced as dry ice sublimates. Since carbon dioxide gas is heavier, on average, than air as a whole, the carbon dioxide gas that is generated by sublimation tends to settle below most of the other components of air that are in the insulated container. This often results in a temperature gradient within the container, with the bottom of the container being at temperatures of −78° C. or less and with the top of the container being at temperatures much warmer than −78° C. As can be appreciated, such a temperature gradient within the container may be undesirable as different portions of the payload may be exposed to different temperatures, some of which may be outside the desired temperature range.

If the objective is simply to maintain a payload at a low temperature, one practical solution may be to insulate the payload well and to use an excess amount of dry ice. However, as alluded to above, some pharmaceutical products require transportation and storage within strict minimum and maximum temperatures. For example, certain COVID-19 vaccines require storage at temperatures that are no less than −80° C. and that are no greater than −60° C. Unfortunately, however, for at least some of the reasons discussed above, many dry ice passive thermal systems often experience temperatures below −80° C., which is unsuitable for articles like the aforementioned COVID-19 vaccine, which should not be exposed to temperatures below −80° C. In fact, as noted by Mei, it is not uncommon for temperatures to be as low as −85° C. in many dry ice passive thermal systems, rendering such systems unsuitable for the foregoing COVID-19 vaccine. Moreover, Mei demonstrated experimentally how a temperature as low as −93° C. was reached in a dry ice passive thermal system that was placed on one side, instead of being upright. As can be appreciated, such low temperatures are unsuitable for many articles like the above-noted COVID-19 vaccine.

Accordingly, there is a clear need for a dry ice passive thermal system that experiences minimal supercooling.

Documents that may be of interest may include the following, all of which are incorporated herein by reference: U.S. Pat. No. 6,868,982 B2, inventor Gordon, issued Mar. 22, 2005; U.S. Pat. No. 8,250,882 B2, inventors Mustafa et al., issued Aug. 28, 2012; U.S. Pat. No. 9,045,278 B2, inventors Mustafa et al., issued Jun. 2, 2015; U.S. Pat. No. 9,180,998 B2, inventors Banks et al., issued Nov. 10, 2015; U.S. Pat. No. 10,583,978 B2, inventors Longley et al., issued Mar. 10, 2020; U.S. Pat. No. 10,604,326 B2, inventors Longley et al., issued Mar. 31, 2020; U.S. Pat. No. 10,661,969 B2, inventors Pranadi et al., issued May 26, 2020; U.S. Pat. No. 11,137,190 B2, inventor Martino, issued Oct. 5, 2021; U.S. Patent Application Publication No. US 2022/0002070 A1, inventors Moghaddas et al., published Jan. 6, 2022; U.S. Patent Application Publication No. US 2021/0024270 A1, inventor Mirzaee Kakhki, published Jan. 28, 2021; U.S. Patent Application Publication No. US 2020/0002075 A1, inventors Lee et al., published Jan. 2, 2020; U.S. Patent Application Publication No. US 2019/0210790 A1, inventors Rizzo et al., published Jul. 11, 2019; U.S. Patent Application Publication No. US 2018/0328644 A1, inventors Rizzo et al., published Nov. 15, 2018; and U.S. Patent Application Publication No. US 2018/0100682 A1, inventors Nilsen et al., published Apr. 12, 2018.

SUMMARY OF THE INVENTION

It is an object of the present invention to provide a novel system for storing and/or transporting temperature-sensitive materials.

It is another object of the present invention to provide a system as described above that overcomes at least some of the disadvantages associated with existing systems.

It is still another object of the present invention to provide a system as described above that has a minimal number of parts, that is easy to manufacture, and that is easy to use.

Therefore, according to one aspect of the invention, there is provided a system for storing and/or transporting a payload of temperature-sensitive materials, the system comprising: (a) an insulation base, the insulation base comprising a plurality of pieces joined together at one or more interfaces to define a cavity for receiving the payload of temperature-sensitive materials, the insulation base having an open top; (b) an outer box, the insulation base being disposed within the outer box; and (c) a gas flow director, the gas flow director reducing the egress of gas from the cavity of the insulation base through the one or more interfaces, the gas flow director comprising a receptacle having a first opening, the first opening being located at a top end of the receptacle, the gas flow director being disposed within the outer box, the insulation base being disposed within the gas flow director.

In a more detailed feature of the invention, the system may further comprise a quantity of dry ice positioned within the cavity of the insulation base.

In a more detailed feature of the invention, the system may further comprise a product box for receiving the payload of temperature-sensitive materials.

In a more detailed feature of the invention, the insulation base may comprise a bottom and a plurality of sides, and the gas flow director may cover substantially all of the bottom and the plurality of sides of the insulation base.

In a more detailed feature of the invention, the insulation base may be 5-sided and may comprise a bottom vacuum insulated panel and four side vacuum insulated panels, and the four side vacuum insulated panels may be positioned on top of the bottom vacuum insulated panel.

In a more detailed feature of the invention, the gas flow director may not cover any of the open top of the insulation base.

In a more detailed feature of the invention, the gas flow director may cover a portion, but not an entirety, of the open top of the insulation base.

In a more detailed feature of the invention, the first opening of the gas flow director may be defined at least in part by a lip of the receptacle extending inwardly over the open top of the insulation base along at least one side thereof.

In a more detailed feature of the invention, the lip of the receptacle may extend inwardly by at least 1 inch.

In a more detailed feature of the invention, the lip of the receptacle may extend inwardly by about 4-5 inches.

In a more detailed feature of the invention, the first opening of the gas flow director may be defined at least in part by a lip of the receptacle extending inwardly over the open top of the insulation base along all sides thereof.

In a more detailed feature of the invention, the first opening of the gas flow director may be substantially centered relative to the open top of the insulation base.

In a more detailed feature of the invention, the first opening of the gas flow director may be offset relative to the open top of the insulation base.

In a more detailed feature of the invention, the first opening may be at least 2-3 inches wide.

In a more detailed feature of the invention, the gas flow director may further comprise a second opening, and the second opening may be located along a side of the receptacle.

In a more detailed feature of the invention, the receptacle may comprise a flexible bag.

In a more detailed feature of the invention, the flexible bag may comprise a minimally breathable polymer film or sheet.

In a more detailed feature of the invention, the minimally breathable polymer film or sheet may comprise a material selected from the group of a high density polyethylene, a polypropylene, and a polyamide/polyethylene composite.

In a more detailed feature of the invention, the receptacle may further comprise a sheet shaped to define the first opening, and the sheet may be coupled to the flexible bag.

In a more detailed feature of the invention, the first opening may be adjustable in size.

In a more detailed feature of the invention, the gas flow director may further comprise a drawstring mechanism for adjusting the size of the first opening.

In a more detailed feature of the invention, the system may further comprise an insulation lid, and the insulation lid may be removably positionable over the open top of the insulation base.

In a more detailed feature of the invention, the first opening of the gas flow director may be positioned below the insulation lid when the insulation lid is positioned over the insulation base.

In a more detailed feature of the invention, the first opening of the gas flow director may be positioned over the insulation lid when the insulation lid is positioned over the insulation base.

In a more detailed feature of the invention, the first opening may be at least 2-3 inches wide.

According to another aspect of the invention, there is provided a system for storing and/or transporting a payload of temperature-sensitive materials, the system comprising: (a) an insulation base, the insulation base comprising a plurality of pieces joined together at one or more interfaces to define a cavity for receiving the payload of temperature-sensitive materials, the insulation base having an open top; (b) an insulation lid, the insulation lid being removably mounted over the insulation base to cover the cavity; (c) a quantity of dry ice positioned within the cavity of the insulation base; (d) an outer box, the insulation base being disposed within the outer box; and (e) a gas flow director, the gas flow director reducing the egress of gas from the cavity of the insulation base through the one or more interfaces, the gas flow director comprising a receptacle having a first opening, the first opening being located at a top end of the receptacle and being positioned between the open top of the insulation base and the insulation lid, the gas flow director being disposed within the outer box, the insulation base being disposed within the gas flow director.

In a more detailed feature of the invention, the insulation base may be 5-sided and may comprise a bottom vacuum insulated panel and four side vacuum insulated panels, and the four side vacuum insulated panels may be positioned on top of the bottom vacuum insulated panel.

In a more detailed feature of the invention, the receptacle may comprise a flexible bag.

In a more detailed feature of the invention, the first opening may be adjustable in size.

According to still another aspect of the invention, there is provide a method for storing and/or transporting a payload of temperature-sensitive materials, the method comprising: (a) providing a shipper, the shipper comprising (i) an insulation base, the insulation base comprising a plurality of pieces joined together at one or more interfaces to define a cavity for receiving the payload of temperature-sensitive materials, the insulation base having an open top; (ii) an outer box, the insulation base being disposed within the outer box; and (iii) a gas flow director, the gas flow director reducing the egress of gas from the cavity of the insulation base through the one or more interfaces, the gas flow director comprising a receptacle having a first opening, the first opening being located at a top end of the receptacle, the gas flow director being disposed within the outer box, the insulation base being disposed within the gas flow director; (b) loading a payload into the cavity of the insulation base; and (c) loading a quantity of dry ice into the cavity of the insulation base.

For purposes of the present specification and claims, various relational terms like "top," "bottom," "proximal," "distal," "upper," "lower," "front," and "rear" may be used to describe the present invention when said invention is positioned in or viewed from a given orientation. It is to be understood that, by altering the orientation of the invention, certain relational terms may need to be adjusted accordingly.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. These drawings are not necessarily drawn to scale, and certain components may have undersized and/or oversized dimensions for purposes of explication. In the drawings wherein like reference numerals represent like parts.

DETAILED DESCRIPTION OF THE INVENTION

As noted above, one of the problems associated with conventional dry ice passive thermal system is that such systems often experience accelerated sublimation of the dry ice contained therewithin, thereby resulting in undesirably lowered temperatures (i.e., supercooling). Without wishing to be limited to any particular theory as to how such supercooling occurs and without providing an exhaustive identification of all of the causes thereof, the present inventors provide some information below in the context of a simplified conventional dry ice passive thermal system.

Figure 1:
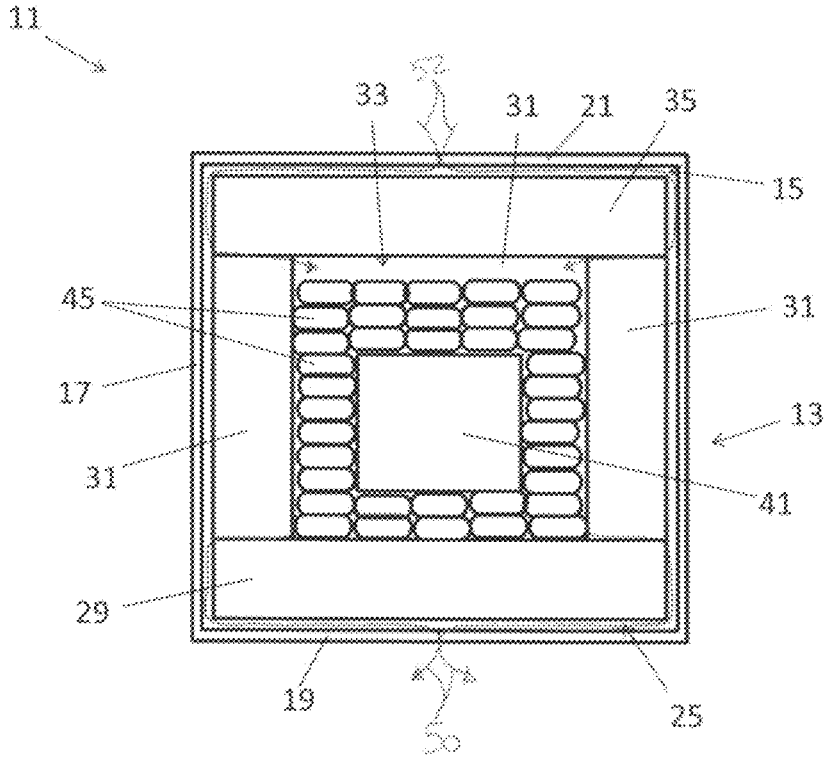
FIG. 1 is a simplified side view, partly in section, of a conventional dry ice passive thermal system, the dry ice passive thermal system being shown in an upright orientation.
Figure 2:
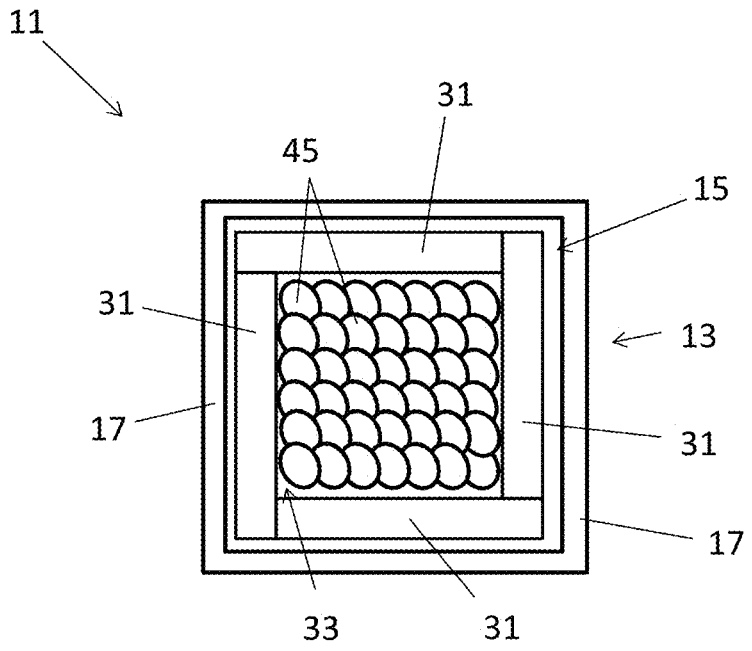
FIG. 2 is a simplified top view of the conventional dry ice passive thermal system of FIG. 1, the dry ice passive thermal system being shown without the top portion of its outer box and without its insulation lid.

Referring now to FIGS. 1 and 2, there are shown simplified renderings of a conventional dry ice passive thermal system, the conventional dry ice passive thermal system being represented generally by reference numeral 11. For clarity and ease of illustration, certain details of system 11 (including cross-hatching) have been omitted from one or more of FIGS. 1 and 2 and/or are shown in one or more of FIGS. 1 and 2 in a simplified fashion.

System 11 comprises an outer box 13. In the present embodiment, outer box 13 is a conventional corrugated cardboard box shaped to include a rectangular prismatic cavity 15 bounded by a plurality of side walls 17, a plurality of bottom closure flaps 19, and a plurality of top closure flaps 21.

System 11 also comprises an insulation base 25. In the present embodiment, insulation base 25 is shown disposed within cavity 15 of outer box 13 and comprises a bottom VIP 29 and four side VIPs 31 (the front VIP not being shown). Bottom VIP 29 and side VIPs 31 are held together by straps (not shown) to form a coherent 5-sided unit defining a cavity 33 having an open top. Insulation base 25 may be similar to insert 11 of U.S. Pat. No. 10,766,685 B2 inventors Kuhn et al., Sep. 8, 2020, which is incorporated herein by reference, and/or insulation unit 51 of U.S. Patent Application Publication No. 2018/0328644 A1, inventors Rizzo et al., published Nov. 15, 2018.

System 11 further comprises an insulation lid 35, insulation lid 35 being removably positionable on top of insulation base 25 to provide access to cavity 33. In the present embodiment, insulation lid 35 comprises a top VIP that is dimensioned to cover the open top of insulation base 25, said top VIP being similar in construction and dimensions to bottom VIP 29.

System 11 further comprises a product box 41. Product box 41, which is removably disposed within cavity 33 of insulation base 25, is a corrugated cardboard box configured to removably retain a payload of temperature-sensitive materials.

System 11 further comprises a quantity of dry ice pellets 45. In the present embodiment, dry ice pellets 45 are positioned on all sides of product box 41, but this need not be the case. Also, for purposes of explication, although dry ice pellets 45 are shown in FIGS. 1 and 2 in an ordered arrangement with identically shaped and sized pellets, it is to be understood that, in practice, dry ice pellets 45 may not be arranged in such an ordered fashion and may have variations in size and/or shape.

In use, as dry ice pellets 45 sublimate, gaseous carbon dioxide is produced. Because gaseous carbon dioxide is heavier than many of the other components of air, the gaseous carbon dioxide that is produced by sublimation tends to settle at the bottom of cavity 33. Although the individual VIPs of insulation base 25 are assembled in a way to minimize gaps between adjacent VIPs, the interfaces between adjacent VIPs are not gastight. Consequently, gas from within cavity 33 tends to leak through insulation base 25, typically at the interfaces between bottom VIP 29 and side VIPs 31 (as well as at the interfaces between adjacent side VIPs 31). Because the carbon dioxide produced by the sublimation of dry ice tends to settle at the bottom of cavity 33, such carbon dioxide tends to escape from cavity 33 at the panel interfaces proximate to the bottom of insulation base 25 and then enters the space between insulated base 25 and outer box 13, settling at the bottom of cavity 15 of outer box 13. Thereafter, such carbon dioxide tends to escape from outer box 13 through the spaces between bottom closure flaps 19. The flow of sublimated carbon dioxide from within cavity 33 to outside of system 11 is schematically illustrated in FIG. 1 by arrows 50.

Concurrent with the egress of gaseous carbon dioxide from within system 11, ambient air from outside system 11 enters outer box 13. Such an ingress of ambient air into system 11 may be attributable, in part, to the differential in gas pressure inside and outside of system 11 due to the above-described loss of gas from within system 11. Because outer box 13 is not gastight and because the interface between insulation base 25 and insulation lid 35 is not gastight (in part to avoid gas pressure buildup within cavity 33 as the dry ice sublimates), ambient air from outside of outer box 13 is able to enter outer box 13 and then is able to flow between insulation lid 35 and insulation base 25 into cavity 33. The flow of ambient air into cavity is illustrated in FIG. 1 by arrows 52. Because such ambient air tends to be warmer than the contents of cavity 33, the introduction of such ambient air into cavity 33 causes additional sublimation of dry ice pellets 45.

Consequently, the collective effect of the egress of gas from within system 11 and the ingress of ambient air into system 11 is a conductive flow of warm ambient air over dry ice pellets 45, causing additional sublimation of dry ice pellets 45 and a resulting drop in temperature of the interior of cavity 33.

Figure 3:
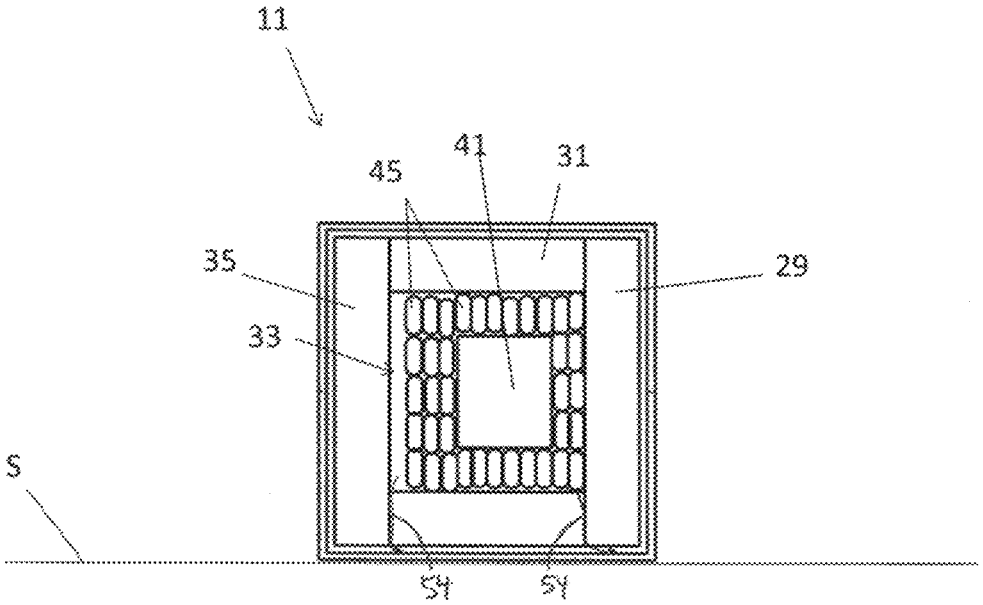
FIG. 3 is a simplified side view, partly in section, of the conventional dry ice passive thermal system of FIG. 1, the dry ice passive thermal system being shown oriented on its side on a surface.

As noted above, the problem of supercooling in a dry ice passive thermal system can be exacerbated when the system is positioned on one of its sides, instead of being oriented upright. An illustration of this scenario is provided in FIG. 3, which shows dry ice passive thermal system 11 resting on a surface S, with system 11 oriented on one of its sides. As can be seen, when system 11 is in such an orientation, the carbon dioxide that is produced by the sublimation of dry ice pellets 45 and that has settled downwardly within cavity 33 may more easily escape from cavity 33 (see arrows 54). This may be, in part, because such carbon dioxide may more easily escape from cavity 33 not only through the interfaces of VIPs within insulation base 25 but also through the interface between insulation base 25 and insulation lid 35. (The interface between insulation base 25 and insulation lid 35 may be even less gastight than the interface between adjacent VIPs of insulation base 25. This may particularly be the case if insulation lid 35 has become slightly dislodged from insulation base 25 while in this sideways orientation. Moreover, the panel interfaces between the bottom VIP 29 and side VIPs 31 are aligned with gravity in this sideways orientation.)

The present invention is based, at least in part, on the surprising discovery that the above-described problem of supercooling in a dry ice passive thermal system can be ameliorated by reducing the above-described conductive gas flow through the system. In at least one embodiment, such a reduction may be achieved by reducing the egress of gas from within the cavity of the insulation base through one or more of the insulation base interfaces and/or by reducing the ingress of ambient air into the cavity of the insulation base through the open top end of the insulation base. In at least one embodiment, the reduction in the egress of gas from within the cavity of the insulation base and/or the reduction in the ingress of ambient air into the cavity of the insulation base may be accomplished using a device having limited transmissibility to gas flow therethrough. In at least one embodiment, such a device may comprise a receptacle into which the insulation base and, optionally, the insulation lid may be positioned. In at least one embodiment, the device may comprise a bag. In at least one embodiment, the bag may be a unitary structure or may comprise a plurality of pieces that are joined together. In at least one embodiment, the bag may have an opening at one end. In at least one embodiment, the device may further comprise a mechanism for reducing the size of the opening while still maintaining patency of the opening. In at least one embodiment, such a mechanism may comprise a drawstring. In at least one embodiment, the bag may be dimensioned to cover substantially the entirety of the insulation base. In at least one embodiment, the bag may be dimensioned so as not to cover any of the open top of insulation base. In at least one embodiment, the bag may be dimensioned to cover the entirety of the insulation base and a portion, but not the entirety, of the open top of the insulation base. In at least one embodiment, the bag may be dimensioned to cover the entirety of the insulation base and a portion, but not the entirety, of the insulation lid.

Figure 4:
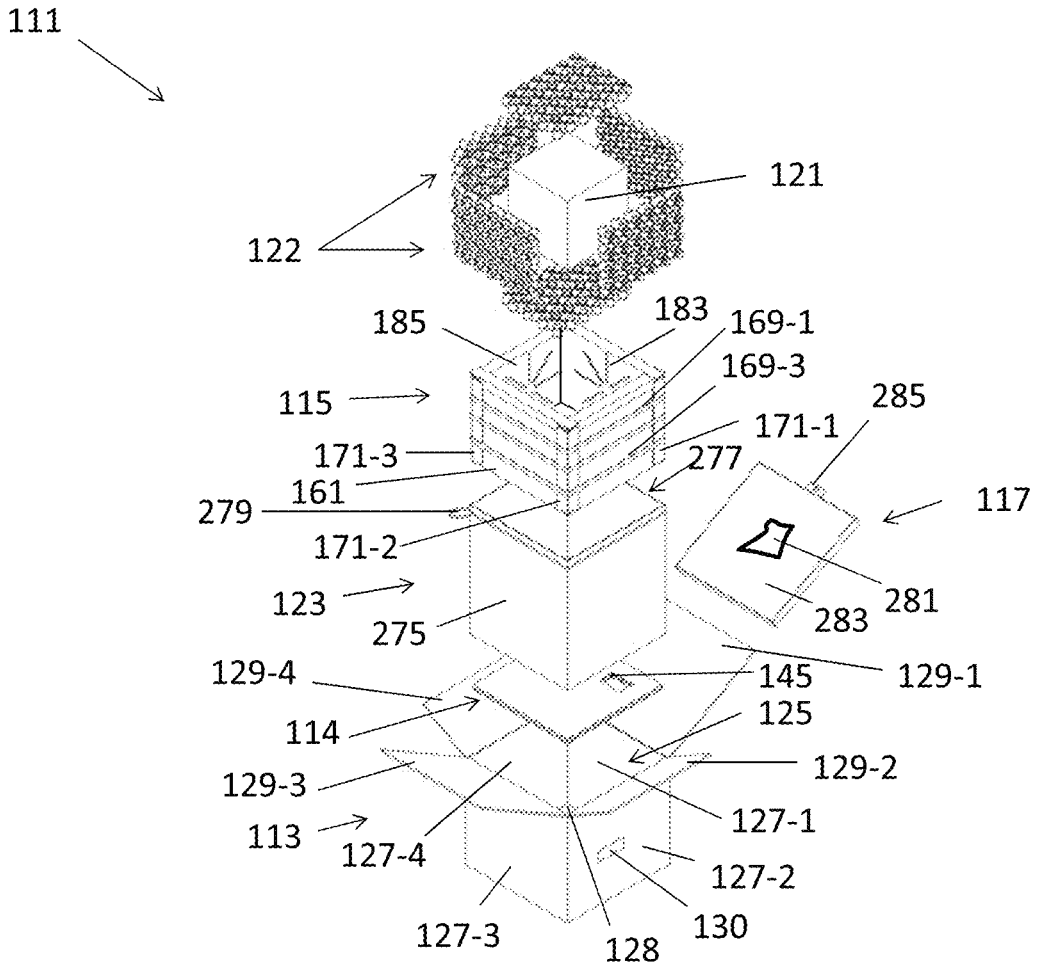
FIG. 4 is a partly exploded perspective view, broken away in part, of a first embodiment of a dry ice passive thermal system constructed according to the present invention.
Figure 5:
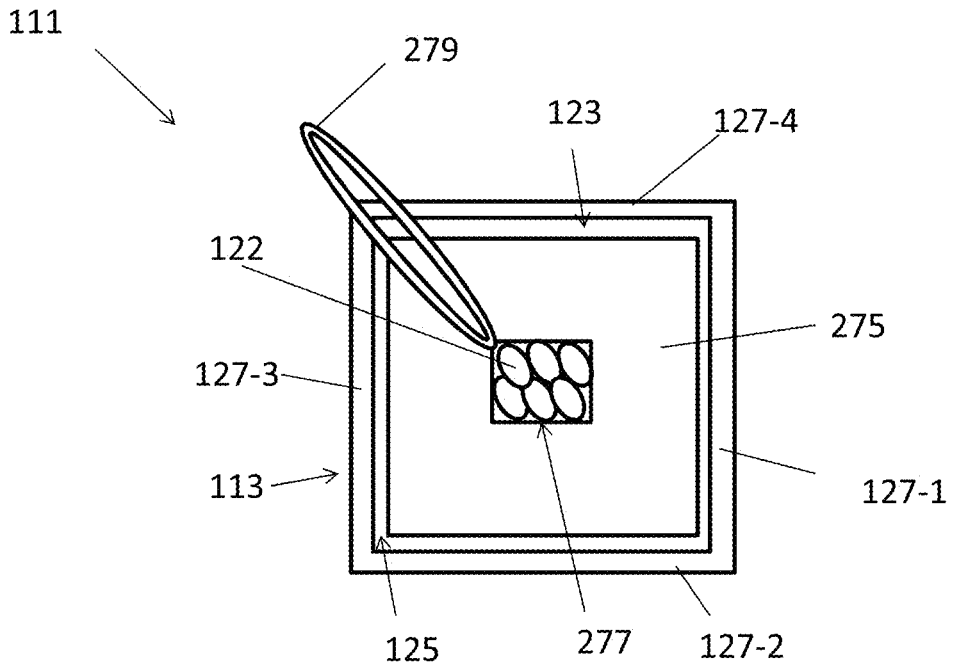
FIG. 5 is a simplified top view of the dry ice passive thermal system of FIG. 4, the dry ice passive thermal system being shown without the top portion of its outer box, without the insulation lid, and without the bottom board and being shown with its gas flow director partially closed over the top end of the insulation base.

Referring now to FIGS. 4 and 5, there are shown different views of a first embodiment of a dry ice passive thermal system constructed according to the present invention, the dry ice passive thermal system being represented generally by reference numeral 111. For clarity and/or ease of illustration, certain details of dry ice passive thermal system 111 that are discussed elsewhere in this application or that are not critical to an understanding of the invention may be omitted from one or more of FIGS. 4 and 5 and/or may be shown in one or more of FIGS. 4 and 5 in a simplified manner.

System 111, which may be similar in certain respects to system 11 of U.S. Patent Application Publication No. US 2022/0002070 A1, may comprise an outer box 113, a bottom board 114, an insulation base assembly 115, an insulation lid assembly 117, a product box 121, a plurality of dry ice pellets 122, and a gas flow director 123.

Outer box 113, which may be, for example, a conventional corrugated cardboard box or carton, may comprise a rectangular prismatic cavity 125 bounded by a plurality of rectangular side walls 127-1 through 127-4, a plurality of bottom closure flaps (with bottom closure flap 128 the only of the four bottom closure flaps being shown), and a plurality of top closure flaps 129-1 through 129-4. Adhesive strips of tape or other closure means (not shown) may be used to retain, in a closed condition, the bottom closure flaps and/or the top closure flaps 129-1 through 129-4. A label 130 may be adhered to or otherwise affixed to outer box 113.

Bottom board 114 may be positioned snugly within outer box 113 at the bottom of cavity 125. Bottom board 114 may be, for example, a piece of honeycomb corrugated cardboard, and may be shaped to include a transverse opening 145. Opening 145 may be appropriately dimensioned to snugly receive a data logger (not shown). Notwithstanding the above, if desired, bottom board 114 may be omitted from system 111.

Figure 6:
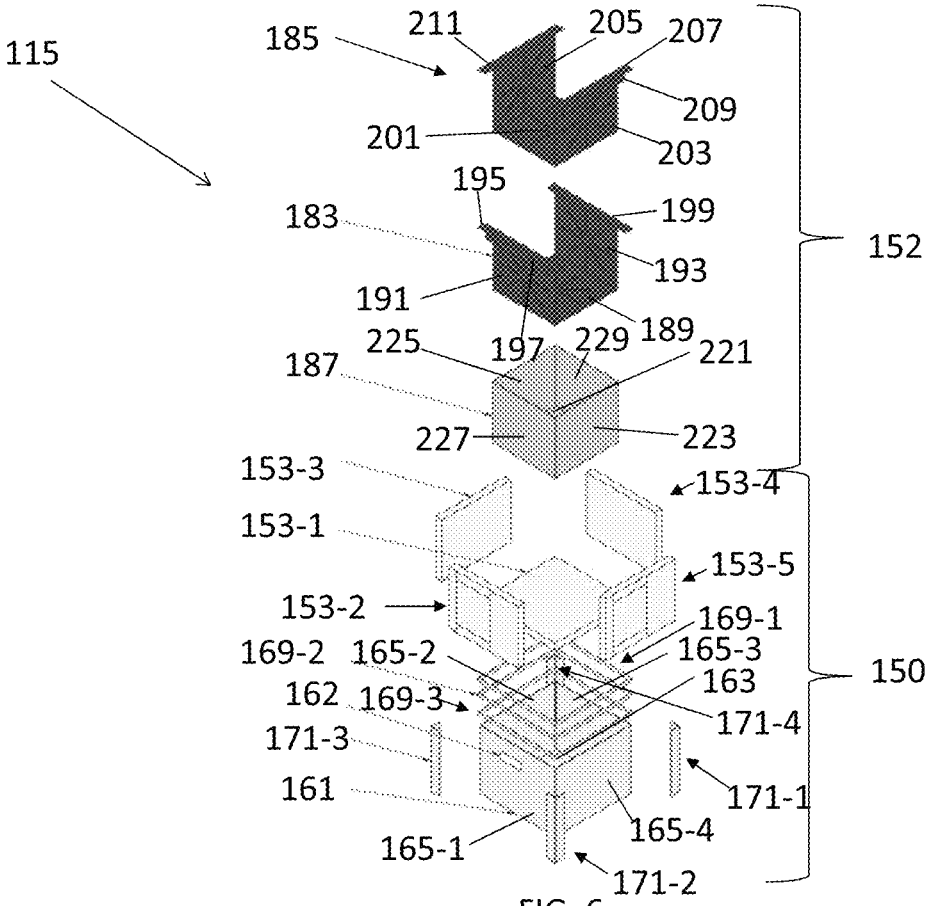
FIG. 6 is a partly exploded perspective view of the insulation base assembly shown in FIG. 4.

Insulation base assembly 115, which is also shown separately in FIG. 6, may comprise an insulation base 150 and a liner assembly 152. Insulation base 150, in turn, may comprise a plurality of vacuum insulated panels 153-1 through 153-5, which may be similar or identical to one another. Panels 153-1 through 153-5, which may be conventional vacuum insulated panels, may be arranged in such a manner that vacuum insulated panels 153-2 through 153-5 are positioned perpendicularly relative to and sitting directly on top of vacuum insulated panel 153-1 so as to define a generally prismatic cavity bounded by a bottom wall and four side walls. The four side walls may be positioned relative to one another in a "pinwheel"-type arrangement, wherein one end of each vacuum insulated panel abuts the inside major surface of its adjacent vacuum insulated panel. Alternatively, the four side walls may be positioned relative to one another so that one end of each of two parallel vacuum insulated panels abuts the inside major surface of each of the two remaining parallel vacuum insulated panels.

Insulation base 150 may additionally comprise a support 161. Support 161, which may be made of corrugated cardboard or the like, may be a blank adapted to be folded into a unitary box-like structure configured to include a central portion 163 and four side portions 165-1 through 165-4. (When folded, the adjacent edges of side portions 165-1 through 165-4 may be spaced apart by a small distance.) Central portion 163 may be rectangular, and each of four side portions 165-1 through 165-4 may extend upwardly from a different one of the four sides of the central portion 163. Support 161 may be appropriately dimensioned so that the central portion 163 of support 161 may be positioned under vacuum insulated panel 153-1 and so that side portions 165-1 through 165-4 of support 161 may be positioned along the outside faces of vacuum insulated panels 153-2 through 153-5, as well as along the peripheral edges of vacuum insulated panel 153-1. Support 161 may be used, in conjunction with other structural members, to help keep vacuum insulation panels 153-1 through 153-5 assembled together. In addition, support 161 may also provide some additional thermal insulation to insulation base 151. A label 162 may be affixed to support 161.

Insulation base 150 may further comprise a plurality of plastic binding straps 169-1 through 169-3. Straps 169-1 through 169-3, which may be conventional binding straps, may be wrapped around the four sides of support 161 and may be used to help retain vacuum insulated panels 153-1 through 153-5 in an assembled state and to keep support 161 in a folded state. It is to be understood that, although three straps 169-1 through 169-3 are shown in the present embodiment, there could be as few as one strap or as many as four or more straps.

Insulation base 150 may further comprise a plurality of corner boards 171-1 through 171-4. Corner boards 171-1 through 171-4 may be identical to one another. Corner boards 171-1 through 171-4 may be made of Kraft paper and may have a thickness, for example, of 0.06 to 0.08 inch. Corner boards 171-1 through 171-4 may be positioned vertically at the four exterior corners defined by support 161 and may help to increase the thermal life of insulation base 150 by keeping panels 153-1 through 153-5 together and tighter for a longer period of time and by protecting support 161 and panels 153-1 through 153-5 from physical damage that may be caused by straps 169-1 through 169-3, particularly at the four corners of insulation base 150. Corner boards 171-1 through 171-4 also may help to increase the length of time that straps 169-1 through 169-3 are able to hold a minimal required tension in a reuse application.

Insulation base 150 may be assembled as follows: First, support 161 may be folded and then placed in a fixture (not shown), whereby side portions 165-1 through 165-4 may be maintained in a generally perpendicular orientation relative to central portion 163. Next, panel 153-1 may be positioned with its bottom major surface flush on top of central portion 163. Next, panels 153-2 through 153-5 may be positioned on top of panel 153-1 in a "pinwheel" arrangement. (Preferably, the seams of panels 153-1 through 153-5 face outwardly towards support 161.) Next, corner boards 171-1 through 171-4 may be placed around the exterior four corners defined by the support 161. Next, straps 169-1 through 169-3 may be wrapped around support 161 and corner boards 171-1 through 171-4. (Preferably, each of straps 169-1 through 169-3 provides a tension of at least 10 psi.) The resulting structure is a five-sided unit defining a cavity bounded by a bottom and four sides and having an open top. As can be appreciated, in the absence of the combination of support 161, straps 169-1 through 169-3, and corner boards 171-1 through 171-4, there is nothing keeping panels 153-1 through 153-5 in an assembled state.

Liner assembly 152, which may be removably mounted on insulation base 150, may comprise a two-piece liner, namely, a first liner piece 183 and a second liner piece 185, and may further comprise a liner support 187.

First liner piece 183 may comprise a sheet of material foldable into a generally U-shaped structure. More specifically, when folded, first liner piece 183 may include a bottom wall 189 extending generally horizontally, a left inner wall 191 extending generally perpendicularly upwardly relative to bottom wall 189, and a right inner wall 193 extending generally perpendicularly upwardly relative to bottom wall 189, with left inner wall 191 and right inner wall 193 extending from opposite ends of bottom wall 189. In addition, first liner piece 183 may further include a left top wall 195 extending generally perpendicularly outwardly from the top of left inner wall 191 and a left outer wall 197 extending generally perpendicularly downwardly for a short distance from the outer edge of left top wall 195. Moreover, first liner piece 183 may further include a right top wall 199 extending generally perpendicularly outwardly from the top of right inner wall 193 and a right outer wall (not shown) extending generally perpendicularly downwardly a short distance from the outer edge of right top wall 199 analogously to left outer wall 197.

Second liner piece 185 may comprise a sheet of material foldable into a generally U-shaped structure. More specifically, when folded, second liner piece 185 may include a bottom wall 201 extending generally horizontally, a front inner wall 203 extending generally perpendicularly upwardly relative to bottom wall 201, and a rear inner wall 205 extending generally perpendicularly upwardly relative to bottom wall 201, with front inner wall 203 and rear inner wall 205 extending from opposite ends of bottom wall 201. In addition, second liner piece 185 may further include a front top wall 207 extending generally perpendicularly outwardly from the top of front inner wall 203 and a front outer wall 209 extending generally perpendicularly downwardly a short distance from the outer edge of front top wall 207. Moreover, second liner piece 185 may further include a rear top wall 211 extending generally perpendicularly outwardly from the top of rear inner wall 205 and a rear outer wall (not shown) extending generally perpendicularly downwardly a short distance from the outer edge of rear top wall 211 analogously to front outer wall 209.

Each of first liner piece 183 and second liner piece 185 may be made of a material that is substantially liquid-impermeable and that may easily be cleaned if soiled, and first liner piece 183 and second liner piece 185 may be made of the same type of such a material. For example, first liner piece 183 and second liner piece 185 may be made of a molded polymer (such as a polyethylene terephthalate) or a similarly suitable material.

Liner support 187 may be similar in structure to support 161 but may be smaller in size so that liner support 187 may be removably inserted into the cavity defined by vacuum insulated panels 153-1 through 153-5 of insulation base 150. Liner support 187 may comprise a single sheet of corrugated cardboard or similar material and may be folded to define a bottom 221, a front 223, a rear 225, a left side 227, and a right side 229. Liner support 187 may be dimensioned so that, when liner support 187 is inserted into insulation base 150, bottom 221 may be seated on vacuum insulated panel 153-1 (or may be closely spaced therefrom), and one or more of left side 227, rear 225, right side 229, and front 223 may be abutting vacuum insulated panels 153-2 through 153-5, respectively (or may be closely spaced therefrom). Liner support 187 may be incapable of maintaining a folded state on its own and may be maintained in a folded state by virtue of being snugly received within the cavity of insulation base 150; alternatively, liner support 187 may be maintained in a folded state on its own or may be maintained in a folded state by adhesive tape or other suitable means.

First liner piece 183 may be removably inserted into liner support 187 and, by virtue of being inserted into liner support 187, may be transformed from a generally planar state to the above-described folded state. (First liner piece 183 may be incapable of maintaining a folded state on its own.) When inserted into liner support 187, bottom wall 189 of first liner piece 183 may be seated directly on top of bottom 221 of liner support 187, left inner wall 191 of first liner piece 183 may be positioned against or proximate to left side 227 of liner support 187, left top wall 195 of first liner piece 183 may be positioned directly over or proximate to the top of left side 227 of liner support 187, and left outer wall 197 of first liner piece 183 may be positioned parallel to and spaced a short distance away from left side 227 of liner support 187. In addition, right inner wall 193 of first liner piece 183 may be positioned against or proximate to right side 229 of liner support 187, right top wall 199 of first liner piece 183 may be positioned directly over or proximate to the top of right side 229 of liner support 187, and the right outer wall connected to right top wall 199 may be positioned parallel to and spaced a short distance away from right side 229 of liner support 187.

Second liner piece 185 may also be removably inserted into liner support 187 and, by virtue of being inserted into liner support 187, may be transformed from a generally planar state to the above-described folded state. (Second liner piece 185 may be incapable of maintaining a folded state on its own.) More specifically, bottom wall 201 of second liner piece 185 may be seated directly on top of bottom wall 189 of first liner piece 183, front inner wall 203 of second liner piece 185 may be positioned against or proximate to front 223 of liner support 187, front top wall 207 of second liner piece 185 may be positioned directly over or proximate to the top of front 223 of liner support 187, and front outer wall 209 of second liner piece 185 may be positioned parallel to and spaced a short distance away from front 223 of liner support 187. In addition, rear inner wall 205 of second liner piece 185 may be positioned against or proximate to rear 225 of liner support 187, rear top wall 211 of second liner piece 185 may be positioned directly over or proximate to the top of rear 225 of liner support 187, and the rear outer wall connected to top wall 211 may be positioned parallel to and spaced a short distance away from rear 225 of liner support 187.

First liner piece 183 and second liner piece 185 may be appropriately dimensioned so that, when insulation base 150 and liner assembly 152 are brought together, the top portions of liner support 187, vacuum insulated panels 153-2 through 153-5, and support 161 may be covered by the combination of first liner piece 183 and second liner piece 185. For example, the top portions of left side 227 of liner support 187, vacuum insulated panel 153-2, and side 165-1 of support 161 may be positioned between left inner wall 191 and left outer wall 197 of first liner piece 183. In this manner, first liner piece 183 and second liner piece 185 may provide some protection to the top portions of vacuum insulated panels 153-2 through 153-5. In addition, the inner-facing exposed surfaces of vacuum insulated panels 153-1 through 153-5 may be covered by (and, thus, protected by) bottom 221, left side 227, rear 225, right side 229, and front 223, respectively, of liner support 187. The protection to the inner-facing exposed surfaces of vacuum insulated panels 153-1 through 153-5 that is afforded by liner support 187 may be particularly advantageous since first liner piece 183 and second liner 185 may have exposed edges that otherwise could cause damage to vacuum insulated panels 153-1 through 153-5. First liner piece 183 and second liner piece 185 may additionally provide some protection to the top, outer surfaces of vacuum insulated panels 153-2 through 153-5.

Notwithstanding the above discussion regarding liner assembly 152, it is to be understood that system 111 need not include a liner; thus, liner assembly 152 could be omitted in its entirety from system 111, thereby leaving system 111 without a liner. Alternatively, system 111 could include any of a number of different types of alternative liners to liner assembly 152. For example, system 111 could include, as a liner, a structure similar or identical to liner support 187.

Referring back now to FIG. 4, insulation lid assembly 117 may comprise a vacuum insulated panel 281. Vacuum insulated panel 281, which may be conventional and, in fact, may be similar or identical to vacuum insulated panel 153-1, may be removably secured, for example, using complementary hook and loop fasteners (not shown), adhesive fasteners, or other suitable means, to the interior face of top closure flap 129-1.

In addition, insulation lid assembly 117 may further comprise a protective cover 283, which may be made of the same material as first liner piece 183 and second liner piece 185. Protective cover 283 may be removably secured, for example, using complementary hook and loop fasteners (not shown), adhesive fasteners, or other suitable means, to vacuum insulated panel 281 to cover the exposed surfaces thereof.

Vacuum insulated panel 281 is preferably positioned on top closure flap 129-1, and cover 283 is preferably positioned on vacuum insulated panel 281 in such a way that the cavity formed by first liner piece 183 and second liner piece 185 may be closed simply by the closure of top closure flap 129-1. A tab 285, which may be made of a sheet of polymeric material, such as a polyvinyl chloride or a similar material, may be secured, for example, by adhesive or similar means, to the interior face of top closure flap 129-1, and tab 285 may extend across a free edge of top closure flap 129-1. In this manner, a user may swing open top closure flap 129-1 from a closed state by pulling generally upwardly on tab 285. Preferably, vacuum insulated panel 281 and protective cover 283 are dimensioned so that, when top closure flap 129-1 is closed, cover 283 is seated directly on top of the top surfaces of first liner piece 183 and second liner piece 185, and vacuum insulated panel 281 is disposed within the top portion of cavity 125 of outer box 113.

It is to be understood that, although, in the present embodiment, insulation base assembly 115 and insulation lid assembly 117 comprise vacuum insulated panels, insulation base assembly 115 and/or insulation lid assembly 117 need not comprise vacuum insulated panels and, instead, may comprise other types of insulation materials, such as panels of foam insulation (e.g., expanded polystyrene insulation, polyurethane foam insulation).

Product box 121 may be used to removably receive temperature-sensitive materials (not shown). Product box 121, which may be a conventional corrugated cardboard box, may be appropriately dimensioned to be removably received within the cavity collectively defined by first liner piece 183 and second liner piece 185. Notwithstanding the above, if desired, product box 121 could be omitted from system 111.

Dry ice pellets 122 may be conventional in nature and may be positioned in a desired quantity along on one or more sides of product box 121. Although, for purposes of explication, dry ice pellets 122 are shown in FIG. 4 in ordered arrays of identically shaped and sized pellets, it is to be understood that, in practice, dry ice pellets 122 may not be arranged in such a fashion and may have variations in size and/or shape from pellet to pellet.

Gas flow director 123 may be used to address the above-described phenomenon of supercooling in a dry ice thermal passive system by reducing the conductive gas flow through the system. To this end, gas flow director 123 may comprise a receptacle 275, into which insulation base assembly 115 may be removably received. Receptacle 275 may be a unitary (i.e., one-piece) structure; alternatively, receptacle 275 may comprise a plurality of separate pieces that are joined together in some fashion. In the present embodiment, receptacle 275 may be in the form of a flexible bag comprising an opening 277 at a top end thereof. It is to be understood that, although receptacle 275 is shown in FIGS. 4 and 5 as having a generally rectangular shape, receptacle 275 is not limited to such a shape and may assume any bag shape. Also, it is to be understood that the gap between the sides of receptacle 275 and outer box 113 in FIG. 5 is exaggerated since, in practice, there is preferably little or no space between receptacle 275 and outer box 113.

Receptacle 275 may consist of or comprise one or more films or sheets, each film or sheet comprising one or more layers. Since the primary purpose of gas flow director 123 is to inhibit gas movement, receptacle 275 preferably (or optimally) consists of or comprises one or more materials that possess a low transmissibility to gas flow therethrough (i.e., possess minimal breathability). Materials that may be suitable for use as receptacle 275 may include polymeric films or sheets having minimal or no porosity. Such polymeric films or sheets may have a thickness of about 1-10 mils and may consist of or comprise materials including, but not limited to, a high density polyethylene (HDPE), polypropylene, and a nylon (polyamide)/polyethylene composite.

Although the desirability of a material for use as receptacle 275 may be evaluated in more than one way, one way for evaluating a potential material for use as receptacle 275 may be by determining whether the material passes both of the following two tests and, thus, may be regarded as minimally breathable: (1) a breath test; and (2) a balloon test.

The aforementioned breath test is a simplified version of ASTM D737, where the pressure differential between two sides of a material is created by placing the material against one's mouth and blowing hard against it, generating air movement. If breath moves through the material, either freely or with moderate difficulty, the material is considered not to pass the breath test.

The aforementioned balloon test involves pulling a candidate material flat across the surface of one end of a polypropylene tube (50 mL Conical Centrifuge Tubes, Product ID LBCT500S, with bottom cut off) and then attaching the material to the tube using a rubber band, making a drum. Polyester fleece (PrimaLoft® Black Insulation, product ID: 1-3047) measuring approximately 1 cubic inch is placed inside the tube above the test material. Dry ice pellets are placed within the tube to fill it. Lastly, a natural rubber latex balloon (9 inch Neon Assorted, purchased from Walmart Inc.) is placed over the top of the tube to allow the gradual pressure buildup to be visualized. The tube is held balloon-side up for about 1 minute to allow for inflation. If the balloon does not inflate, or the balloon does inflate but gas is easily pushed through the sample material by gently squeezing the balloon, the material is considered not to pass the balloon test. If the balloon inflates and the sample material is able to hold back the gas when the balloon is gently squeezed, the material is considered to pass the balloon test.

Using successful performance under the above-described breath test and the above-described balloon test as prerequisites, illustrative examples of materials that may be suitable for use as receptacle 275 include the following: (i) high density polyethylene (HDPE), 1 mil thick, seam length 35 inches, bag height 50 inches, purchased from Donahue-Corry Associates, Inc. (Berlin, MA); and (ii) nylon/polyethylene plastic composite, 9 mil thick, purchased from Donahue-Corry Associates, Inc. (Berlin, MA).

It should be understood that certain materials that do not pass the above-described breath and balloon tests, while perhaps not constituting optimal materials for receptacle 275, may nonetheless be acceptable in some applications.

Gas flow director 123 may further comprise a drawstring 279 that may be configured to adjust the size of opening 277 between maximally open (as in FIG. 4) and minimally open (as in FIG. 5). In the present embodiment, receptacle 275 is dimensioned to receive the entirety of insulation base assembly 115, with the top of receptacle 275 covering a portion, but not the entirety, of the opening at the top end of insulation base assembly 115. In the present embodiment, the opening at the top end of insulation base assembly 115 has dimensions of 10.75 inches (length)×10.75 inches (width), and opening 277, when closed to the greatest extent possible, may have dimensions of about 2.75 inch (length)× about 2.75 inch (width). However, it is to be understood that, in certain instances, the minimum dimensions of opening 277 may be modified to be less than or greater than those discussed above so long as gas flow director 123 still adequately performs its function. For example, as will be discussed further below, in certain cases, it may be acceptable for the gas flow director to be dimensioned so that it provides only 5-sided coverage of insulation base assembly 115, with the opening at the top end of insulation base assembly 115 completely uncovered by any portion of the gas flow director. In other cases, the gas flow director not only may provide 5-sided coverage of insulation base assembly 115 but also may provide some coverage, but not complete coverage, of the opening at the top end of insulation base assembly 115. For example, in some cases, the gas flow director may cover as little as a 1-inch lip or border around some or all of the sides of the opening at the top end of insulation base assembly 115 whereas, in other cases, the gas flow director may cover all but a small portion (e.g., an opening of about 2-3 inches or less in width or diameter) of the opening at the top end of the insulation base assembly 115.

It is to be understood that, although, in the present embodiment, gas flow director 123 includes drawstring 279, other measures may be used for tightening opening 277 while still maintaining some patency at the top end of receptacle 275. For example, one could fold the top end of receptacle 275 to define opening 277 and then use adhesive tape to maintain the size and shape opening 277.

Also, it is to be understood that, although perhaps not as preferred as the structures discussed above, the gas flow director could comprise the combination of a bag having an open top end and a film or sheet secured to the open top end of the bag, wherein the film or sheet is provided with an opening of desired dimensions and placement.

To use system 111, one may load bottom board 114 (optionally with a data logger) into outer box 113. In addition, one may load a payload into product box 121, one may insert product box 121 into insulation base assembly 115, and one may insert insulation base assembly 115 into receptacle 275 of gas flow director 123. The combination of gas flow director 123, insulation base assembly 115, and product box 121 may then be loaded into outer box 113 on top of bottom board 114. Next, dry ice pellets 122 may be loaded into insulation base assembly 115 on one or more sides of product box 121. Next, drawstring 279 may be used to close the top of receptacle 275 over a portion, but not the entirety, of the top of insulation base assembly 115. Next, top closure flaps 129-1 through 129-4 of outer box 113 may be closed, causing insulation lid 117 to cover the tops of receptacle 275 and insulation base assembly 115.

System 111 will experience reduced supercooling as compared to a comparable system lacking gas flow director 123. Without wishing to be limited to any particular theory behind the invention, it is believed that gas flow director 123 reduces the incidence of supercooling by disrupting conductive gas flow through the system. More specifically, it is believed that, because gas flow director 123 has a low transmissibility to gas flow, gas flow director 123 decreases the egress of cold gas from within insulation base 115 through the interfaces between the adjacent VIPs thereof. As a result, because the egress of cold gas from insulation base 115 is decreased, the ingress of ambient air into the insulation base through the open top end of the insulation base meets does not occur to the extent that it otherwise would.

Figure 7:
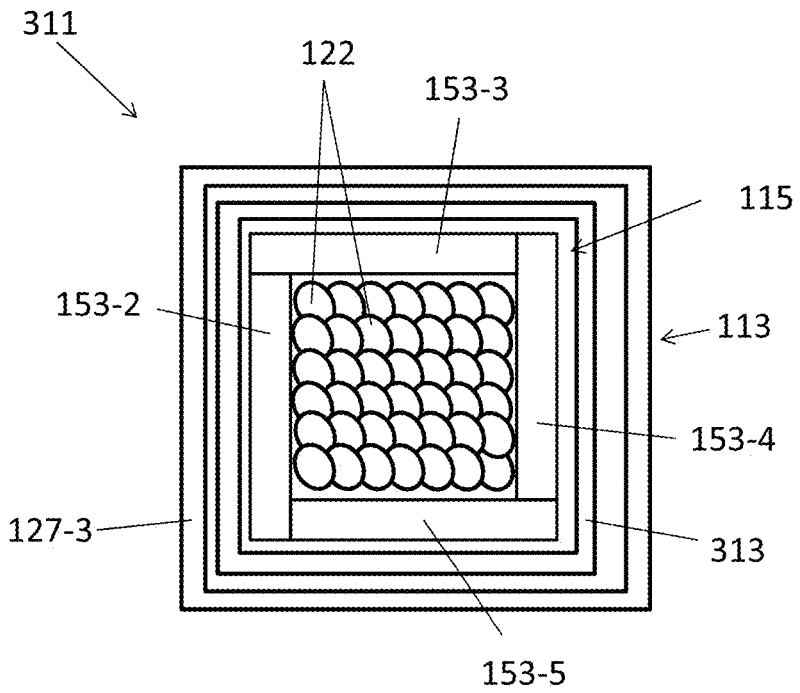
FIG. 7 is a simplified top view of a second embodiment of a dry ice passive thermal system constructed according to the present invention, the dry ice passive thermal system being shown without the top portion of its outer box, without the insulation lid, and without certain components of the insulation base assembly.

Referring now to FIG. 7, there is shown a simplified top view of a second embodiment of a dry ice passive thermal system constructed according to the present invention, the dry ice passive thermal system being represented generally by reference numeral 311. For clarity and/or ease of illustration, certain details of dry ice passive thermal system 311 that are discussed elsewhere in this application or that are not critical to an understanding of the invention may be omitted from FIG. 7 and/or may be shown in FIG. 7 in a simplified manner.

System 311 may be similar in many respects to system 111, the principal difference between the two systems being that, whereas system 111 may comprise a gas flow director 123, system 311 may instead comprise a gas flow director 313.

Gas flow director 313 may be similar in certain respects to gas flow director 123. One difference between the two gas flow directors may be that, whereas gas flow director 123 may be dimensioned to completely cover the bottom and four sides of insulation base assembly 115, as well as a portion of the opening at the top end of insulation base assembly 115, gas flow director 313 may be dimensioned to cover only the bottom and four sides of insulation base assembly 115 (or the bottom and substantially all of the four sides of insulation base assembly 115), without covering any of the top end of insulation base assembly 115. In other words, gas flow director 313 may only provide 5-sided coverage of insulation base assembly 115. Another difference between the two gas flow directors may be that, whereas gas flow director 123 may comprise a drawstring 279 or other mechanism for closing the opening at the top of receptacle 275, gas flow director 313 may not include a drawstring or other mechanism for closing the opening at its top end.

It is to be understood that the gaps between gas flow director 313 and outer box 113 and between gas flow director 313 and insulation base assembly 115 in FIG. 7 are exaggerated since, in practice, there is preferably little or no space between these respective structures.

System 311 may be used in a manner analogous to that described above for system 111.

Figure 8:
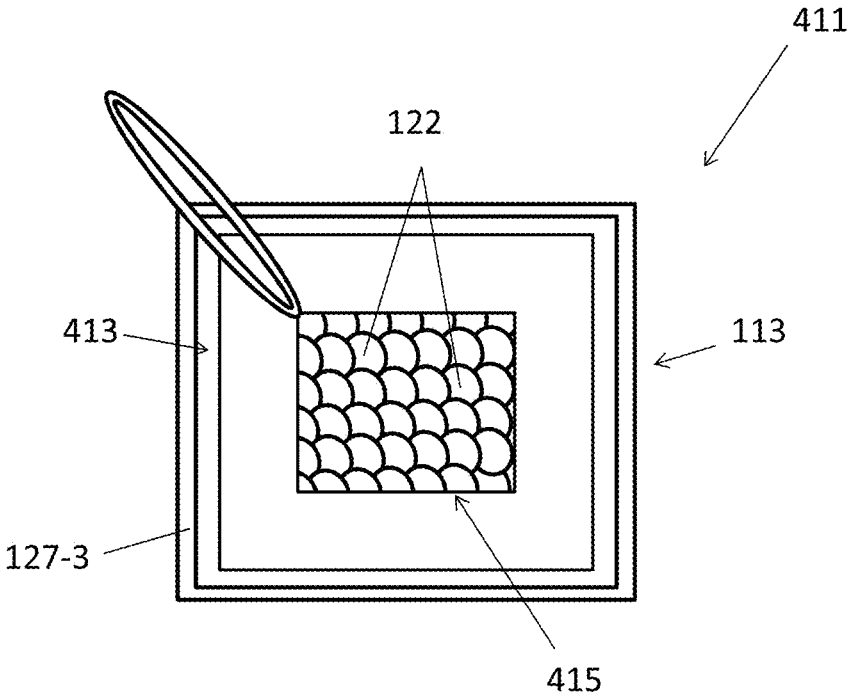
FIG. 8 is a simplified top view of a third embodiment of a dry ice passive thermal system constructed according to the present invention, the dry ice passive thermal system being shown without the top portion of its outer box and without the insulation lid.

Referring now to FIG. 8, there is shown a simplified top view of a third embodiment of a dry ice passive thermal system constructed according to the present invention, the dry ice passive thermal system being represented generally by reference numeral 411. For clarity and/or ease of illustration, certain details of dry ice passive thermal system 411 that are discussed elsewhere in this application or that are not critical to an understanding of the invention may be omitted from FIG. 8 and/or may be shown in FIG. 8 in a simplified manner.

System 411 may be similar in many respects to system 111, the principal difference between the two systems being that, whereas system 111 may comprise a gas flow director 123, system 411 may instead comprise a gas flow director 413. Gas flow director 413 may be similar in certain respects to gas flow director 123. One difference between the two gas flow directors may be that, whereas gas flow director 123 may be dimensioned to include an opening 277 having dimensions of about 2.75 inch (length)×2.75 inch (width) formed by a 4-inch lip extending over all four sides of the opening at the top end of the insulation base assembly, gas flow director 413 may instead be dimensioned to include an opening 415 having dimensions of about 8.75 inch (length)× 8.75 inch (width) formed by a 1-inch lip extending over the opening at the top end of the insulation base assembly.

It is to be understood that the gap between gas flow director 413 and outer box 113 in FIG. 8 is exaggerated since, in practice, there is preferably little or no space between these structures.

System 411 may be used in a manner analogous to that described above for system 111.

Figure 9:
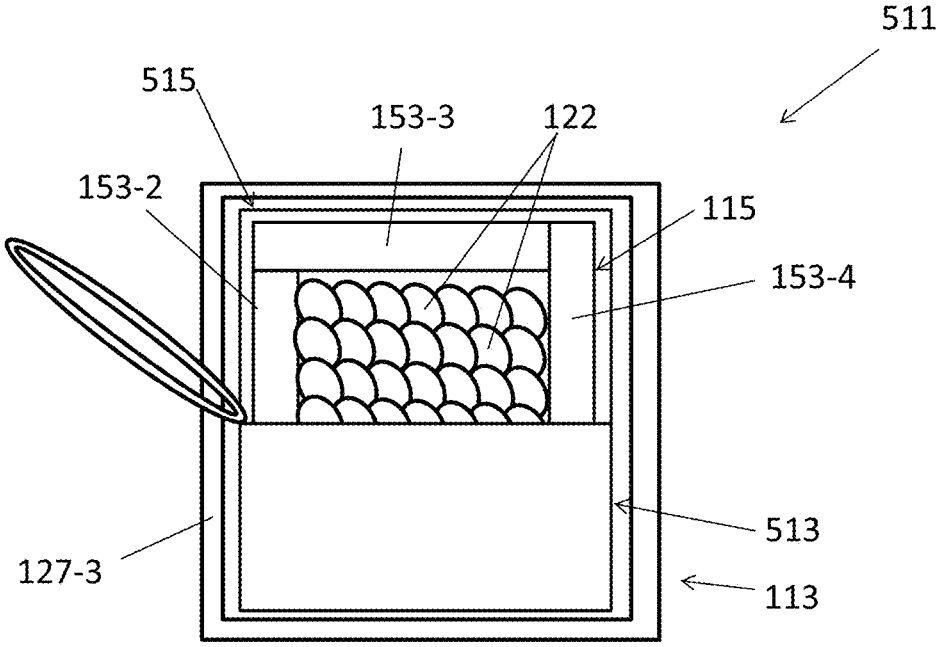
FIG. 9 is a simplified top view of a fourth embodiment of a dry ice passive thermal system constructed according to the present invention, the dry ice passive thermal system being shown without the top portion of its outer box, without the insulation lid, and without certain components of the insulation base assembly.

Referring now to FIG. 9, there is shown a simplified top view of a fourth embodiment of a dry ice passive thermal system constructed according to the present invention, the dry ice passive thermal system being represented generally by reference numeral 511. For clarity and/or ease of illustration, certain details of dry ice passive thermal system 511 that are discussed elsewhere in this application or that are not critical to an understanding of the invention may be omitted from FIG. 9 and/or may be shown in FIG. 9 in a simplified manner.

System 511 may be similar in many respects to system 111, the principal difference between the two systems being that, whereas system 111 may comprise a gas flow director 123, system 511 may instead comprise a gas flow director 513. Gas flow director 513 may be similar in certain respects to gas flow director 123. One difference between the two gas flow directors may be that, whereas gas flow director 123 may be dimensioned to include a symmetrical opening 277 having dimensions of about 2.75 inch (length)×2.75 inch (width) formed by a 4-inch lip extending over all sides of the opening at the top end of the insulation base assembly, gas flow director 513 may instead be dimensioned to include an asymmetrical opening 515 formed by a 5-inch lip extending over only one side of the opening at the top end of the insulation base assembly.

It is to be understood that the gap between gas flow director 513 and outer box 113 and the gap between gas flow director 513 and insulation base assembly 115 in FIG. 9 is exaggerated since, in practice, there is preferably little or no space between these structures.

System 511 may be used in a manner analogous to that described above for system 111.

Figure 10:
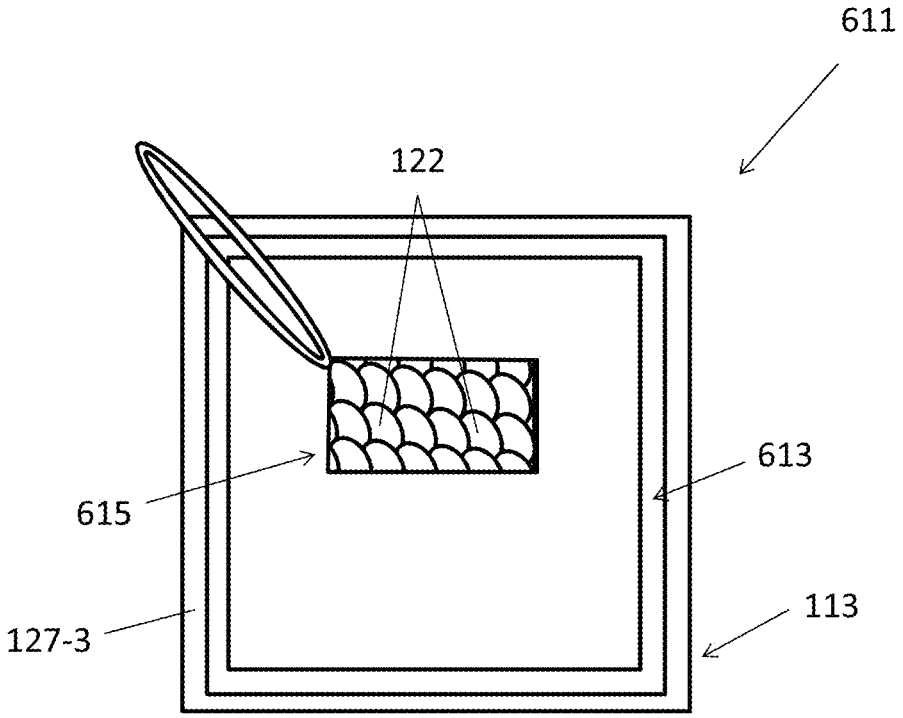
FIG. 10 is a simplified top view of a fifth embodiment of a dry ice passive thermal system constructed according to the present invention, the dry ice passive thermal system being shown without the top portion of its outer box and without the insulation lid.

Referring now to FIG. 10, there is shown a simplified top view of a fifth embodiment of a dry ice passive thermal system constructed according to the present invention, the dry ice passive thermal system being represented generally by reference numeral 611. For clarity and/or ease of illustration, certain details of dry ice passive thermal system 611 that are discussed elsewhere in this application or that are not critical to an understanding of the invention may be omitted from FIG. 10 and/or may be shown in FIG. 10 in a simplified manner.

System 611 may be similar in many respects to system 111, the principal difference between the two systems being that, whereas system 111 may comprise a gas flow director 123, system 611 may instead comprise a gas flow director 613. Gas flow director 613 may be similar in certain respects to gas flow director 123. One difference between the two gas flow directors may be that, whereas gas flow director 123 may be dimensioned to include a symmetrical opening 277 formed by a 4-inch lip extending over all sides of the opening at the top end of the insulation base assembly, gas flow director 613 may instead be dimensioned to include an asymmetrical opening 615 formed by a 5-inch lip extending over one side of the opening at the top end of the insulation base assembly and a 1-inch lip extending over the other three sides of the opening at the top end of the insulation base assembly.

It is to be understood that the gap between gas flow director 613 and outer box 113 in FIG. 10 is exaggerated since, in practice, there is preferably little or no space between these structures.

System 611 may be used in a manner analogous to that described above for system 111.

Figure 11:
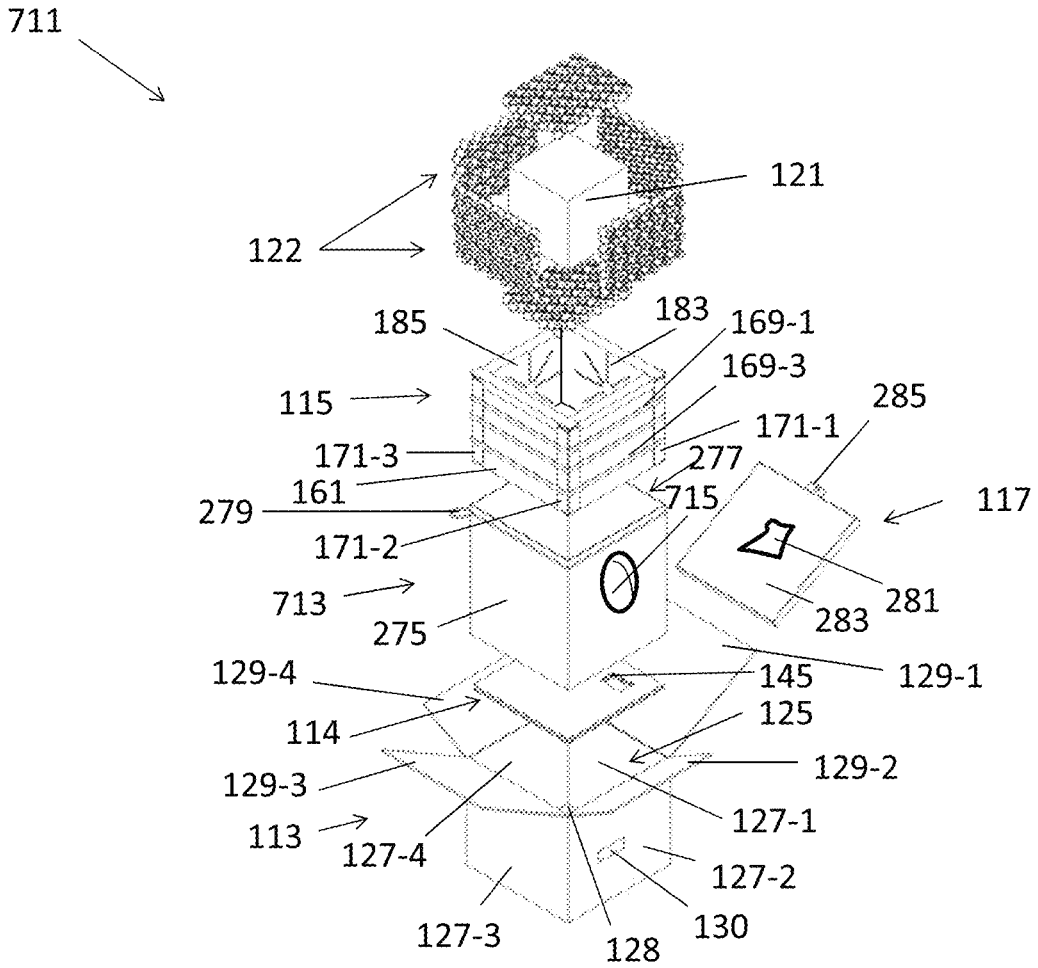
FIG. 11 is a partly exploded perspective view, broken away in part, of a sixth embodiment of a dry ice passive thermal system constructed according to the present invention.

Referring now to FIG. 11, there is shown a partly exploded perspective view, broken away in part, of a sixth embodiment of a dry ice passive thermal system constructed according to the present invention, the dry ice passive thermal system being represented generally by reference numeral 711. For clarity and/or ease of illustration, certain details of dry ice passive thermal system 711 that are discussed elsewhere in this application or that are not critical to an understanding of the invention may be omitted from FIG. 11 and/or may be shown in FIG. 11 in a simplified manner.

System 711 may be similar in many respects to system 111, the principal difference between the two systems being that, whereas system 111 may comprise a gas flow director 123, system 711 may instead comprise a gas flow director 713. Gas flow director 713 may be similar in most respects to gas flow director 123. One difference between the two gas flow directors may be that, whereas gas flow director 123 may include a single opening at its top end, gas flow director 713 may be further configured to include an opening 715 on a side wall thereof. As will be discussed further below, opening 715 may be useful in reducing the occurrence of supercooling when system 711 is positioned sideways, instead of upright.

System 711 may be used in a manner analogous to that described above for system 111.

Figure 12:
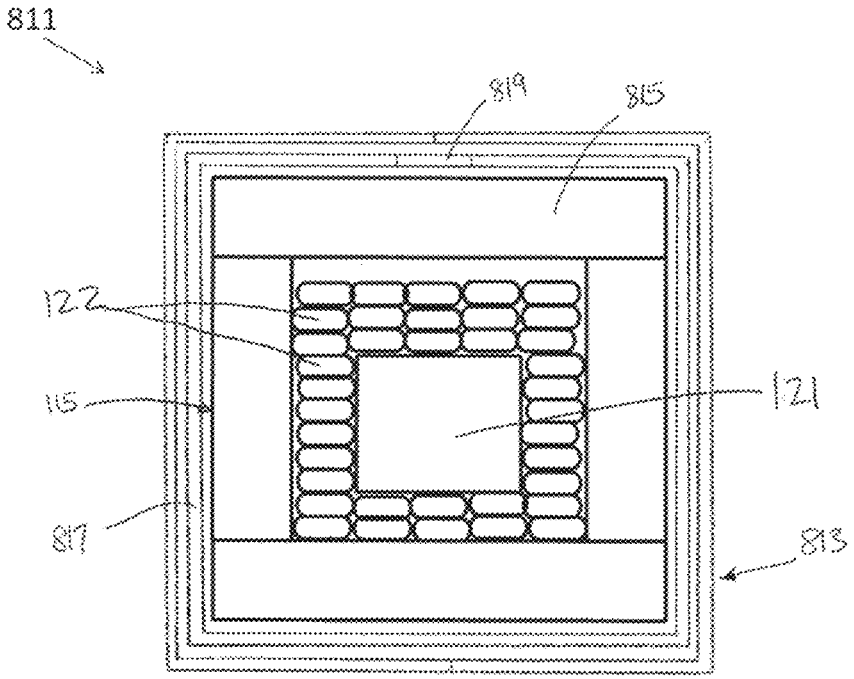
FIG. 12 is a simplified side view, partly in section, of a seventh embodiment of a dry ice passive thermal system constructed according to the present invention.

Referring now to FIG. 12, there is shown a simplified side view, partly in section, of a seventh embodiment of a dry ice passive thermal system constructed according to the present invention, the dry ice passive thermal system being represented generally by reference numeral 811. For clarity and/or ease of illustration, certain details of dry ice passive thermal system 811 (including cross-hatching) have been omitted from FIG. 12 and/or are shown in FIG. 12 in a simplified fashion.

System 811 may be similar in many respects to system 111. One difference between the two systems may be that, whereas system 111 may comprise an outer box 113 and an insulation lid assembly 117 that may be coupled to a top closure flap 129-1 of outer box 113, system 811 may instead comprise an outer box 813 and an insulation lid assembly 815 that are not coupled to one another. Another difference between the two systems may be that, whereas system 111 may comprise a gas flow director 123 that is dimensioned so that its top end may be positioned over the top of insulation base assembly 115 but below insulation lid assembly 117, system 811 may comprise a gas flow director 817 that may be dimensioned to receive not only insulation base assembly 115 but also insulation lid assembly 815.

System 811 may be used in a manner similar to that described above for system 111, except that (i) insulation lid assembly 815 may be placed on top of and removed from insulation base assembly 115 independently of any closing or opening of a top closure flap of the outer box and (ii) insulation lid assembly 815 may be placed within gas flow director 817, together with insulation base assembly 115, prior to reducing the size of the top opening 819 of gas flow director 817.

The following examples are given for illustrative purposes only and are not meant to be a limitation on the invention described herein or on the claims appended hereto. Because pharmaceutical products vary enormously in their size, shape, and thermal properties, the examples below were performed without product loads, with temperature measurement being made using thermocouples taped to the shipper interior. Observed temperatures of −78° C.±5° C. are regarded as exhibiting minimal or no supercooling, observed temperatures below −83° C. are regarded as exhibiting moderate supercooling, and observed temperatures below −90° C. are regarded as exhibiting extreme supercooling.

Example 1: Comparative

A shipper was used that includes an outer corrugate box of cubic geometry with external dimensions 13 11/16 inches× 13 11/16 inches×12 11/16 inches. Into this box was inserted a riser and a 5-piece bottom vacuum insulated panel (VIP) assembly that includes 4 VIPs, each 11.75 inches wide×9 inches tall×1 inch thick arranged in a pinwheeled fashion and strapped together on top of a fifth VIP of dimensions 12.75 inches long×12.75 inches wide×1 inch thick, which serves as a base. One sheet of chipboard, cut into a cross shape, was inserted inside the 5-piece bottom assembly so that all 5 sides of the interior were covered by the chipboard. On top of the chipboard, two lengths of plastic sheet, pre-shaped to conform to the internal contour of the VIP assembly were arranged at right angles to each other inside the cavity created by the VIP assembly, thereby creating a rigid inner lining. A sixth VIP of the same dimensions as the fifth VIP was encased in a rigid plastic case and was attached to one upper corrugate flap. When the corrugate flaps are closed, the sixth VIP serves as a lid to the VIP assembly. A reusable shipping system of this type is sold commercially by Cold Chain Technologies, LLC (Franklin, MA) under the trademark KOOLTEMP ECOFLEX96. This shipping system is sold with different types and amounts of Phase Change Material (PCM) that surround a centrally positioned product box for refrigerated or controlled room temperature shipments. The system is also suited to shipment of frozen product in dry ice.

Type T thermocouples connected to a Kaye Validator AVS (advanced validation system) temperature validation system (Amphenol Thermometrics, Inc., St. Marys, PA) were taped to the rigid inner lining of the VIP assembly in the following locations: bottom center, side center, top center. Temperatures from the thermocouples, along with ambient thermocouples, were reported in 5-minute intervals and recorded until test end. Since dry ice shippers generally exhibit the lowest temperature at lower locations in the shipper, where dry ice and carbon dioxide gas both settle under gravity, this thermocouple configuration allowed the temperature of both the bottom and one side of the shipper to be measured whether in the upright position, tipped onto its side, or turned upside down.

Dry ice pellets (ACME Dry Ice, Cambridge, MA, product name "Dry Ice Pellets") were added to the interior of the shipper, contacting the rigid inner lining of the VIP assembly. An empty corrugate product box of dimensions 6 inches×6 inches×6 inches was placed centrally and more dry ice was added, filling the interior to the top without overflowing. The shipper had a dry ice open area of 10.75 inches×10.75 inches, as will be discussed later. After closing the lid and taping the top flaps of the outer corrugate box, the entire shipper weighed 31.44 lbs. The shipper was placed on the floor of a laboratory which was kept at 16° C.±2° C. for the duration of the test. The shipper was maintained in the upright orientation with its lid oriented at the top for 1.5 hours, then tipped onto its side for an additional 19.5 hours. The shipper was re-weighed after 21 hours.

Example 2: Reduced Gas Flow

A shipping system similar to that of Example 1 was prepared as above, except that a gas flow director was placed inside the outer corrugate box prior to inserting the 5-piece bottom VIP assembly. The intention was to reduce gas flow through the gaps between the 5 VIPs making up the VIP assembly by providing a non-airtight barrier external to the VIP assembly. The gas flow director was prepared by taking a large plastic trash bag (24"×32" 0.9 mil 12-16 gal LLDPE black CLEAN CHOICE® can liner part number 0606222 from Fastenal Company (Winona, MN), and cutting the top portion off so that the film material only extended up the side walls and did not extend as far as the seam between the lid and VIP assembly. Like the shipper of Example 1, the shipper of Example 2 had a dry ice open area of 10.75 inches×10.75 inches. After closing the lid and taping the top flaps of the outer corrugate box, the entire shipper weighed 30.90 lbs. The shipper was maintained in an upright orientation with its lid oriented at the top for 1.5 hours, then tipped onto its side for an additional 19.5 hours. The shipper was re-weighed after 21 hours.

Example 3: Reduced Gas Flow Directed Through Single Central Vent

A shipping system similar to that of Examples 1 and 2 was prepared as above, except that the plastic bag was cut less severely so that it extended above the side walls. After filling the shipper with dry ice, the extra plastic material was folded over the side walls and duct-taped so that only a small vent hole was left uncovered near the center of the top face. The intention was not only to restrict the gas flow through the gaps between the 5 VIPs making up the VIP assembly by providing a non-airtight barrier, but also to direct gas flow through a single central vent underneath the sixth VIP. After closing the lid and taping the top flaps of the outer corrugate box, the entire shipper weighed 34.38 lbs. The shipper was maintained in an upright orientation with its lid at the top for 1.5 hours, then tipped onto its side for an additional 19.5 hours. The shipper was re-weighed after 21 hours. Then, it was tipped again so that the shipper was upside down compared to its original orientation for an additional 2 hours, after which the test was ended.

Although the vent was centrally located underneath the top VIP panel at the time the shipper was packed, re-orienting resulted in the vent being centrally located on one of the four sides, then at the bottom.

TABLE 1

Rate of Dry Ice Sublimation

| Example | Initial Weight (lb) | Weight after 21 Hours (lb) | Average Weight Loss (lb/hr) |
|---|---|---|---|
| 1 | 31.44 | 22.74 | 0.42 |
| 2 | 30.90 | 25.06 | 0.28 |
| 3 | 34.38 | 30.08 | 0.21 |

Since the shippers of Examples 1-3 were identical, except for the gas flow directors used in Examples 2 and 3, and since the shippers were tested under the same ambient conditions, the reduced rate of dry ice sublimation in Examples 2 and 3 provides evidence that the gas flow between the shipper and its environment was indeed reduced in Examples 2 and 3, as compared to Example 1. In particular, the shipper of Example 3 showed about half the rate of dry ice sublimation compared to that shipper of Example 1.

TABLE 2

Temperature Profile

| Example | Lowest Temperature (Upright) | Lowest Temperature (After Tipping on Side) | Lowest Temperature (After Tipping Upside Down) |
|---|---|---|---|
| 1 | −86.0° C. | −91.7° C. | N/A |
| 2 | −80.4° C. | −89.3° C. | N/A |
| 3 | −80.2° C. | −79.2° C. | −79.2° C. |

The shipper of Example 1 exhibited moderate supercooling, even while upright, and exhibited extreme supercooling (below −90° C.) after being turned on its side. The shipper of Example 2 exhibited no supercooling while in the upright position but moderate (approaching extreme) supercooling when turned on its side. The shipper of Example 3 showed no supercooling at all times in the study: upright, on its side, and upside down.

Example 4: Comparative

In this example, the shipper was prepared in the same way as in Example 1, except that no product box was used, and the shipper was maintained in an upright orientation throughout the test, a total of 94 hours. Extreme supercooling was experienced, with the lowest temperature being −92.3° C. The shipper weighed 39.88 lbs at the start and weighed 24.02 lbs after 94 hours, resulting in an average dry ice sublimation rate of 0.17 lbs/hr.

Example 5: Reduced Gas Flow Directed Through Two Central Vents

A shipping system similar to that of Example 3 was prepared, except that an additional vent hole was cut into the gas flow director, the additional vent hole being positioned centrally on one side (the same side as the lid hinge). Since a top vent hole was also created, the shipper of this example had two central vents. This shipper did not experience supercooling. The lowest temperature reached was −82.1° C. When the shipper was opened at the end of the test, it was visually confirmed that the gas flow director had remained in place, without either vent hole shifting position. This example demonstrates that the gas flow director does not need to be limited to having a single vent hole to prevent supercooling. The shipper weighed 38.08 lbs at the start and 27.74 lbs after 94 hours, resulting in an average dry ice sublimation rate of 0.11 lbs/hr, considerably less than the shipper of Example 4.

Example 6: Internally Positioned Gas Flow Director with Single Central Vent

A shipping system similar to that of Example 3 was prepared, except that the gas flow director was positioned within the cavity of the VIP assembly, instead of around the exterior of the VIP assembly. After placing the gas flow director inside the VIP assembly, dry ice was added directly on top of the gas flow director. No product box was used. After filling the shipper with dry ice, the extra plastic material of the gas flow director was folded over the dry ice and duct-taped so that only a small vent hole was left uncovered near the center of the top face. The intention was to restrict gas flow through the gaps between the 5 VIPs making up the VIP assembly by providing a non-airtight barrier inside the assembly, and also to direct gas flow through a single central vent. The shipper weighed 37.72 lbs at the start of the test. The shipper was tipped on its side after 5 hours. Prior to tipping, the lowest temperature was −77.4° C.; after tipping on its side, the shipper reached −85.5° C. This test was stopped after 23 hours. Although this shipper protected against supercooling while upright, moderate supercooling was experienced after tipping. Surprisingly, having the bag directly around the dry ice, on the inside of the VIP assembly, was not enough to mitigate supercooling entirely.

Example 7: Gas Flow Director Made from Breathable Material

A shipping system similar to that of Example 3 was prepared, except that the gas flow director was constructed of a breathable material, instead of a plastic film. More specifically, a piece of TYVEK® fabric was cut from a TYVEK® pallet cover (TYVEK® SOLAR™ W10 pallet cover, Cold Chain Technologies, LLC (Franklin, MA)). The fabric was folded to fit around the outside of the VIP assembly. No product box was used. After filling the shipper with dry ice, the extra TYVEK® material was folded over the side walls and duct-taped so that only a small vent hole was left uncovered near the center of the top face. Dry ice pellets were visible through the vent hole. The intention was to direct the gas flow through a single central vent without providing much of a restriction to gas flow or providing a barrier to carbon dioxide diffusion. The shipper weighed 38.30 lbs at the start of the test. This test continued for 94 hours, and the lowest temperature reached was −88.8° C.

Example 8: Comparative

A shipping system similar to that of Example 4 was prepared, except that the thermocouples were taped to the following locations: bottom center and side center. The internal volume within the shipper, with dimensions 10.75 inches×10.75 inches×8 inches, was filled with dry ice. Then, the shipper was weighed, reaching a total weight of 41 lbs. The lid was closed, and the top flaps of the outer corrugate were taped shut. The shipper was left upright for 17 hours. At this time, the shipper was weighed again, and the lowest temperature was recorded. Immediately after the shipper was weighed, the shipper was tipped on its side. The shipper was then left on its side for 48 hours and weighed periodically to track weight loss. The shipper was also intentionally shaken vertically three times after being weighed at the 41-hour mark while maintaining the tipped orientation. Shaking was vigorous enough so that dry ice could be heard rising and falling within the shipper.

Example 9: 5-Sided Gas Flow Director

A shipping system similar to that of Example 8 was prepared, except that the shipping system included a 5-sided gas flow director made from blue plastic film (high density polyethylene (HDPE), 1 mil thick, seam length 35 inches, bag height 50 inches, purchased from Donahue-Corry Associates, Inc. (Berlin, MA)) placed inside the outer corrugate box prior to inserting the 5-piece bottom VIP assembly. Excess material was cut from the gas flow director so that the film material did not extend over the edge of the VIPs into the dry ice area. The shipper was filled with dry ice and then weighed, reaching a total weight of 42 lbs. The lid was closed, and the top flaps of the outer corrugate were taped shut. Once shut, the shipper was tested the same way as in Example 8.

Example 10: 6-Sided Gas Flow Director, Large Central Vent

A shipping system similar to that of Example 9 was prepared, except that a sixth side was added to the gas flow director. This addition to the gas flow director was a plastic film sheet (Nylon/polyethylene plastic composite, 9 mil thick, purchased from Donahue-Corry Associates, Inc. (Berlin, MA)) with dimensions 12.75 inches×12.75 inches that also had a cut-out centered on the sheet, the cut-out measuring 8.75 inches×8.75 inches. The sheet was placed over the top of the 5-piece bottom VIP assembly and was adhered to one side of the 5-sided gas flow director with packing tape so that it created a flap. The shipper was then filled with dry ice and weighed, with a total weight 41 lbs. A slit was cut in the sheet so that the thermocouples could be threaded through the central vent, and then the slit was taped shut using packing tape. The remaining edges of the sheet were then adhered to the gas flow director using double stick tape. Once the sheet was fully adhered to the gas flow director, the lid was closed, and the flaps were taped shut as above. Once shut, the shipper was tested the same way as in Example 8.

The 6-sided gas flow director of this example had one side (in this case the top side) with a relatively large central vent of 76.6 square inches. Another way to describe the gas flow director of this example is that it covered 5 sides of the VIP assembly completely and extended over the top such that a 1-inch wide lip was created into the dry ice area on each of the four sides.

Example 11: 6-Sided Gas Flow Director, Small Central Vent

A shipping system similar to that of Example 10 was prepared, except that the cut-out centered on the plastic film sheet measured 2.75×2.75 inches. Once shut, the shipper was tested the same way as in Example 8. The total weight of the shipper was 41 lbs.

The 6-sided gas flow director of this example had one side (in this case the top side) with a relatively small central vent of 7.6 square inches. Another way to describe the gas flow director of this example is that it covered 5 sides of the VIP assembly completely and extended over the top such that a 4-inch wide lip was created into the dry ice area on each of the four sides.

TABLE 3

Rate of Dry Ice Sublimation and Lowest Temperature, Shippers Upright

| Example | Description | Dry Ice Area Exposed ($in^2$) | Weight Loss Rate (lb/hr) | Lowest Temperature (° C.) |
|---|---|---|---|---|
| 8 | No Gas Flow Director | 115.6 | 0.21 | −90.2 |
| 9 | 5-sided Gas Flow Director | 115.6 | 0.15 | −80.7 |
| 10 | 6-sided Gas Flow Director (1-inch wide lip) | 76.6 | 0.15 | −81.2 |

TABLE 3-continued

Rate of Dry Ice Sublimation and Lowest Temperature, Shippers Upright

| Example | Description | Dry Ice Area Exposed ($in^2$) | Weight Loss Rate (lb/hr) | Lowest Temperature (° C.) |
|---|---|---|---|---|
| 11 | 6-sided Gas Flow Director (4-inch wide lip) | 7.6 | 0.13 | −80.3 |

As can be seen, the shipping systems of Examples 9 through 11 experienced no supercooling while upright. The shipping system of Example 8 experienced severe supercooling, as it reached −90° C. within 7 hours and remained at this temperature while upright. This shows that supercooling can be mitigated in upright shippers that have at least a 5-sided gas flow director.

Weight loss rate (lb/hr) was also calculated for all four shippers. A lower rate of weight loss is superior for dry ice shipper performance. This is because as the dry ice sublimates, it settles under gravity leaving a pocket of gas that, while cold, tends to be higher in temperature than areas covered by dry ice. Once enough dry ice sublimates to expose a portion of a payload, the material inside may spoil. Therefore, a higher rate of weight loss corresponds to a shorter duration shipper whereas a lower rate of weight loss corresponds to a longer shipper duration. The shipping system of Example 8 had the highest rate of weight loss (0.21 lb/hr). The shipping systems of Examples 9 through 11 had significantly lower rates of weight loss. This can be explained by the gas flow director minimizing gas flow. The shipping system of Example 11 had the lowest rate of weight loss (0.13 lb/hr), compared to the shipping systems of Examples 9 and 10, which had the same rate (0.15 lb/hr). The shipping system of Example 11 also had the smallest amount of area exposed, which would further limit gas flow and weight loss. These results show that loss of dry ice can be slowed in upright shippers that have a gas flow director with at least 5 sides. These results also show that loss of dry ice is further slowed by a 6-sided gas flow director and that the rate of loss further decreases as the vent size decreases when the shipper is upright.

TABLE 4

Rate of Dry Ice Sublimation and Lowest Temperature, Shippers Tipped On Side

| Example | Description | Dry Ice Area Exposed ($in^2$) | Weight Loss Rate (lb/hr) | Lowest Temperature (° C.) | Temperature Drop After Tipping (° C.) |
|---|---|---|---|---|---|
| 8 | No Gas Flow Director | 115.6 | 0.23 | −91.3 | 1.7 |
| 9 | 5-sided Gas Flow Director | 115.6 | 0.27 | −84.3 | 5.9 |
| 10 | 6-sided Gas Flow Director (1-inch wide lip) | 76.6 | 0.18 | −81.0 | 2.5 |
| 11 | 6-sided Gas Flow Director (4-inch wide lip) | 7.6 | 0.18 | −81.0 | 2.9 |

All shipper temperatures dropped immediately after being tipped over, but to varying degrees. The shipper of Example 9 saw the most significant drop, reaching moderate supercooling temperatures when tipped. The shippers of Examples 10 and 11 saw similar temperature drops to one another, but such drops were not considered supercooling. The shipper of Example 8, which was already in a state of severe supercooling when upright, experienced even lower temperatures when tipped. These results demonstrate that a 6-sided gas flow director prevents supercooling when the shipper is tipped on its side, which is a common occurrence in real-life shipping environments.

All rates of weight loss increased when the shippers were tipped over, but again, to varying degrees. The weight loss rate of the shipper of Example 9 increased dramatically, surpassing even that for the shipper of Example 8. These results demonstrate that a 5-sided gas flow director is insufficient to reduce weight loss in a shipping environment where the shipper can tip over. Both the shipper of Example 10 and the shipper of Example 11, each of which had a 6-sided gas flow director, had slower weight loss rates. These results show that a 6-sided gas flow director mitigates dry ice loss when the shipper tips on its side. It is important to note that, despite having very different lip widths and exposed areas, the weight loss rates of the shippers of Examples 10 and 11 were the same. Therefore, additional experiments were conducted to observe this phenomenon more closely.

Only a minor temperature drop (0.5° C. or less) was observed when all shippers were shaken at the 41-hour mark. Compared to the temperature drops observed when tipped (3 to 6° C.), this temperature drop was considered negligible. Therefore, a short-lived shaking event during shipping, such as being placed on a shelf or a truck breaking hard during transport, was not considered a potential cause of supercooling in application.

Example 12: 6-Sided Gas Flow Director, Large Central Vent

A shipping system similar to that of Example 10 was prepared, except that temperature was recorded using a logger (InTemp CX405-RTD Dry Ice Data Logger, purchased from Onset Computer Corporation (Bourne, MA)) with its thermocouple adhered to the side center location against the interior plastic liner. The sheet with the 1-inch wide lip was also adhered to the gas flow director on all four sides using packing tape before dry ice was added. The empty shipper and logger were then weighed, and the shipper was then filled with dry ice and then weighed again. The total dry ice weight was 12 lbs. The lid was then closed, and the outer corrugate flaps were taped shut. The shipper was then left upright on the lab floor for 4 hours. The shipper was then weighed again to determine dry ice weight loss. The shipper was then immediately tipped onto the side with the adhered thermocouple and left there for 140 hours (6 days). The shipper was only disturbed for periodic weight measurements during this time.

Example 13: 6-Sided Gas Flow Director, Moderately Sized Central Vent

A shipping system similar to that of Example 12 was prepared, except that the sheet had a cut-out centered on the sheet measuring 4.75 inches×4.75 inches, which created a 3-inch wide lip that extended into the dry ice area on all sides. After being taped to the gas flow director, a slit was cut in the sheet so that dry ice could enter the interior. The total weight of dry ice was 12 lbs. Once dry ice was added, the cut slit was taped shut with packing tape. The lid was then closed, and the outer corrugate flaps were taped shut. Once shut, the shipper was tested the same way as in Example 12.

TABLE 5

Rate of Dry Ice Sublimation, Shippers Upright

| Example | Description | Dry Ice Area Exposed ($in^2$) | Weight Loss Rate (lb/hr) |
|---|---|---|---|
| 12 | 6-sided Director Gas Flow (1-inch wide lip) | 76.6 | 0.16 |
| 13 | 6-sided Gas Flow Director (3-inch wide lip) | 22.6 | 0.14 |

TABLE 6

Rate of Dry Ice Sublimation, Shippers Tipped On Side

| | Cumulative Dry Ice Weight Loss (%) | |
|---|---|---|
| Duration of Shipper Tipped on Side (hours) | 5-Sided Gas Flow Director, Large Vent | 5-Sided Gas Flow Director, Small Vent |
| 0 | 0% | 0% |
| 2.7 | 2% | 3% |
| 19.0 | 15% | 15% |
| 25.7 | 20% | 20% |
| 42.9 | 32% | 32% |
| 67.1 | 49% | 48% |
| 139.7 | 89% | 89% |

While the shippers were upright, the shipper of Example 12 had a higher weight loss rate than the shipper of Example 13, which corresponded to the difference in dry ice area exposed by the vent (see Table 5). This follows a similar trend observed between the shippers of Examples 10 and 11 (see Table 3) and further confirms the conclusion that, in an upright shipper, a smaller vent provides longer dry ice retention when compared to a larger vent. Weight measurements of the shippers of Examples 12 and 13 over this six-day experiment showed negligible difference in weight loss behavior at any stage of dry ice loss, despite the significant difference in dry ice area exposed. This also confirms the observed trend between the shippers of Examples 10 and 11 (see Table 4) and further confirms the conclusion that, in a tipped shipper, vent size does not significantly impact dry ice weight loss rate, so long as the vent has a lip width of at least 1 inch extending into the dry ice area.

Example 14: 6-Sided Gas Flow Director, Asymmetrical Vent, One Lip

A shipping system similar to that of Example 9 was prepared, except that a sixth side was added to the gas flow director. This addition to the gas flow director was a plastic film sheet with dimensions 12.75 inches×6 inches and was placed over the dry ice area to create an asymmetrical vent with a lip of 5 inches along one edge of the dry ice area and no lip on the opposing edge. The sheet was adhered to the 5-sided gas flow director with packing tape. In this shipper, about half the dry ice area was covered. The shipper was then filled with dry ice and weighed, with a total weight of 38 lbs. No temperature monitoring device was used. The lid was then closed, and the outer corrugate flaps were taped shut. Once shut, the shipper was left upright for 17 hours. Then, the shipper was weighed and immediately tipped on its side, such that the side with the least amount of dry ice area coverage, or smallest lip, touched the ground. After 27 hours in this position, the shipper was again weighed and then immediately tipped so that the side with the most amount of dry ice area coverage, or the widest lip, touched the ground. After 67 hours in this position, the shipper was weighed, and the test was ended.

Example 15: 6-Sided Gas Flow Director, Asymmetrical Vent, Lip on all Edges

A shipping system similar to that of Example 14 was prepared, except that the sixth side of the gas flow director included both the central vent plastic sheet from Example 12, providing a central vent with a 1 inch lip, and the 12.75 inch×6 inch sheet covering about half the dry ice area. This resulted in a smaller vent than in the shipper of Example 14, but the vent was still asymmetric. Both sheets were adhered to the 5-sided gas flow director using packing tape. The shipper was then filled with dry ice and weighed, with a total weight of 37 lbs. No temperature monitoring device was used. The lid was then closed, and the outer corrugate flaps were taped shut. Once shut, the shipper was tested the same way as in Example 14.

TABLE 7

Rate of Dry Ice Sublimation, Shippers Tipped On Side

| Example | Description | Dry Ice Area Exposed ($in^2$) | Small Lip Down Weight Loss Rate (lb/hr) | Wide Lip Down Weight Loss Rate (lb/hr) |
|---|---|---|---|---|
| 14 | 6-sided Gas Flow Director (One lip) | 61.8 | 0.20 | 0.15 |
| 15 | 6-sided Gas Flow Director (Lip on all sides) | 41.6 | 0.18 | 0.15 |

When both shippers were tipped on their side, with the side with the smallest lip touching the ground, the shipper of Example 14 had a higher weight loss rate than the shipper of Example 15. In the shipper of Example 14, the bottom edge of the dry ice area had no protection from convection or gas loss, much like a shipper with only a 5-sided gas flow director. However, once both shippers were tipped so that the widest lip touched the ground, their weight loss rates were the same. In this orientation, they both have protection along the bottom edge of the dry ice area. It is also important to note that the weight loss rates for the shippers of Examples 14 and 15 are both significantly lower than those for the shippers of Examples 8 and 9, which had no gas flow director and a 5-sided gas flow director, respectively. Since, in a typical shipping application, there is no way to know which way the shipper will tip, it is possible to protect all orientations by ensuring there is always a lip of the gas flow director to protect the bottom edge. These examples show that an asymmetric vent can be effective, provided that the vented sixth side utilizes a gas flow director that provides a lip of at least 1 inch to each edge of the dry ice area.

Example 16: Comparative

A shipping system similar to that of Example 8 was prepared, except that temperature was recorded using a logger (InTemp CX405-RTD Dry Ice Data Logger, purchased from Onset Computer Corporation (Bourne, MA)) with its thermocouple adhered to the side center location against the interior plastic liner. The shipper was then filled with dry ice and weighed, with a total weight of 40 lbs. The lid was then closed, and the outer corrugate flaps were taped shut. Once shut, the shipper was left upright for 19 hours. Then, the shipper was weighed and immediately tipped on its side. The shipper was left in the tipped position for 50 hours and weighed periodically for the duration.

Example 17: Folded 6-Sided Gas Flow Director

A shipping system similar to that of Example 9 was prepared, except that temperature was recorded using a logger (InTemp CX405-RTD Dry Ice Data Logger, purchased from Onset Computer Corporation (Bourne, MA)) with its thermocouple adhered to the side center location against the interior plastic liner. A 5-sided gas flow director made of blue plastic film was also cut to leave 11 inches of extra material above the top of the VIP base assembly. The shipper was then filled with dry ice and weighed, with a total weight of 40 lbs. The extra material was then folded on itself over the dry ice area such that a 3.5 inch×3.5 inch central vent remained, and it was then secured in place with duct tape. The lid was then closed, and the outer corrugate flaps were taped shut. Once shut, the shipper was tested the same way as in Example 16.

Example 18: Folded 6-Sided Gas Flow Director, Lid Contained within Gas Flow Director A shipping system similar to that of Example 17 was prepared, except that the lid VIP and its protective black liner were removed from the outer corrugate lid and placed over the dry ice area before the gas flow director was folded and the vent size secured. Once this was done, the outer corrugate flaps were taped shut. The shipper total weight including dry ice was 39 lbs. Once shut, the shipper was tested the same way as in Example 16.

TABLE 8

Rate of Dry Ice Sublimation and Lowest Temperature, Shippers Upright

| Example | Description | Dry Ice Area Exposed ($in^2$) | Weight Loss Rate (lb/hr) | Lowest Temperature (° C.) |
|---|---|---|---|---|
| 16 | No Gas Flow Director | 115.6 | 0.20 | −89.7 |
| 17 | Folded 6-Sided Gas Flow, Director Lid outside Gas Flow Director | 12.3 | 0.16 | −78.0 |
| 18 | Folded 6-Sided Gas Flow Director, Lid inside Gas Flow Director | 12.3 | 0.14 | −78.4 |

TABLE 9

Rate of Dry Ice Sublimation and Lowest Temperature, Shippers Tipped On Side

| Example | Description | Dry Ice Area Exposed ($in^2$) | Weight Loss Rate (lb/hr) | Lowest Temperature (° C.) | Temperature Drop After Tipping (° C.) |
|---|---|---|---|---|---|
| 16 | No Gas Flow Director | 115.6 | 0.21 | −91.0 | 1.3 |
| 17 | Folded 6-Sided Gas Flow Director, Lid outside Gas Flow Director | 12.3 | 0.18 | −81.6 | 3.6 |
| 18 | Folded 6-Sided Gas Flow Director, Lid in Gas Flow Director | 12.3 | 0.21 | −78.6 | 0.2 |

The shippers of Examples 17 and 18, which both had 6-sided gas flow directors, experienced no supercooling while upright. The shipper of Example 16, which had no gas flow director, experienced severe supercooling while upright. These results show that supercooling can be mitigated in upright shippers using a folded 6-sided gas flow director, regardless of whether the lid is contained within the gas flow director or remains outside the gas flow director. The shippers of Examples 17 and 18 also had lower dry ice weight loss rates while upright as compared to the shipper of Example 16.

After tipping on their sides, the shippers of Examples 17 and 18 still did not experience supercooling events, as compared to the shipper of Example 16, where the supercooling continued and became more severe. Again, this shows that a 6-sided gas flow director protects against supercooling in the event of a tip, regardless of whether the lid is inside or outside. However, the shipper of Example 18 did experience a higher weight loss rate when tipped over, equal to the shipper with no gas flow director. It is likely this happened because removal of the lid from the outer corrugate affected the fit of the lid making the system a little less snug, and not necessarily being attributable to the gas flow director. With design improvements to ensure a snug fit of the lid, it is expected that this weight loss rate can be reduced so that the performance is similar to the shipper of Example 17.

Additional comments regarding the present invention are as follows:

As can be seen from the above, the present invention relates, in particular, to the design of insulated containers that use dry ice (solid carbon dioxide) as the refrigerant to maintain very low temperatures during shipping and storage. Rather than trying to avoid air gaps or thermal leaks entirely, the design of the present invention may accommodate them. In one embodiment, gas flow may be directed towards the center of a top face to reduce the effect of cold, dense carbon dioxide gas leaks from the base of the shipper. In another embodiment, the outflow of carbon dioxide gas may be directed away from corners and edges and, instead, may be channeled towards the center of one or more side faces.

The present invention is a protective feature that can be readily added to an existing shipper design in those situations where dry ice is to be used as refrigerant. (This is desirable because a shipping company can maintain one inventory of shipping containers that can be utilized with different types of refrigerant, introducing the inventive design when dry ice is to be used.) Not only does the invention protect from supercooling, but it can reduce the dry ice consumption rate. This offers potential cost savings and lower shipping weight if less dry ice is used, or it can result in longer duration during shipping or storage if the amount of dry ice is unchanged.

The comparative examples discussed above serve to illustrate the known, but poorly understood, phenomenon of dry ice supercooling in insulated shipping containers. The observation that supercooling occurs in some shipping systems under static conditions, while in other shipping containers it can be "turned on and off" by tipping the shipper on its side and back again, illustrates the complexity of the supercooling process.

The process which is responsible for the initiation of a supercooling effect may be analogous to the well-known "stack effect" or "chimney effect" which occurs in buildings, in which a pressure difference between internal and external air causes air to flow in accordance with the pressure differential. This pressure difference, in both shippers and buildings, is caused by a temperature gradient. While a shipping container is a much smaller vessel, compared to a building, in the case of dry ice, there is a substantial temperature gradient between ambient and the shipper interior. This means that, despite its smaller size, a dry ice shipper can build a pressure differential. In addition to this "stack effect," the pressure differential is further increased due to the sublimation of the dry ice, itself, which adds gas to the interior. These two processes together can be considered a driving force to initiate supercooling.

This pressure differential drives the carbon dioxide gas out, and, since the gas is both cold and denser than air, it will naturally flow out those openings or gaps that are located towards the bottom of the shipper. When this happens, warm air is pulled in through other openings or gaps, especially those located towards the top of the shipper, in order to maintain equilibrium. This gas flow creates convection currents, accelerating dry ice sublimation that causes supercooling. The effect can be more pronounced when a shipper is tipped on its side than upright, because the lid provides a gap around the perimeter: the vertical orientation of the gap provides a means for carbon dioxide gas to flow out at the bottom and warm air to flow in at the top.

In a dry ice refrigerated shipper, a number of processes occur simultaneously: carbon dioxide gas tends to settle under gravity; cold carbon dioxide diffuses out of the shipper while warm air diffuses into it; convective flow of warm air drives the sublimation of solid carbon dioxide resulting in cooling. These processes lead to a temperature gradient within the shipping container. Changing the orientation of the shipping container can change affect these processes and change the temperature gradient.

The present invention provides a solution to this problem, namely, the provision of a gas flow director that may be made from nominally wind-proof film material to restrict gas flow, together with a vent design that directs gas flow. Without this gas flow director, gravity will cause cold, dense, carbon dioxide gas to flow most readily out of non-airtight joints located at the lowest places as the shipper changes orientation. Warm air will be pulled in, mainly through non-airtight joints located at higher positions, in order to balance the pressure within the shipper. This creates an active convection cycle that drives dry ice sublimation at a faster rate than would occur under more static conditions. Without being bound to a single explanation, the present inventors believe that a suitably designed gas flow director will direct cold carbon dioxide away from the lowest corner joints, and, instead, route it along a more tortuous path via side panels, which present a better barrier to gas flow. This disrupts the gravity-driven convection that would otherwise accelerate dry ice sublimation and supercooling, instead maintaining temperatures very close to the −78° C. target while utilizing dry ice more effectively during shipping and storage.

The gas flow director does not need to have insulating properties. It can be made from inexpensive materials like polyethylene or polypropylene, and it can be made in the form of a thin, flexible film. The gas flow director does not need to have a carbon dioxide gas barrier coating or metal foil, nor does it need to be made from a material that selectively prevents carbon dioxide diffusion. From a practical perspective, the gas flow director should be non-perforated and any seams should ideally be free of gaps, e.g. heat sealed, taped or glued, rather than folded or sewn. In general, materials that are considered windproof or minimally breathable may be suitable candidate materials.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A system for storing and/or transporting a payload of temperature-sensitive materials, the system comprising:

(a) an insulation base, the insulation base comprising a plurality of pieces joined together at one or more interfaces to define a cavity for receiving the payload of temperature-sensitive materials, the insulation base having an open top;

(b) an outer box, the insulation base being disposed within the outer box; and (c) a gas flow director, the gas flow director reducing the egress of gas from the cavity of the insulation base through the one or more interfaces, the gas flow director comprising a receptacle having a first opening, the first opening being located at a top end of the receptacle, the gas flow director being disposed within the outer box, the insulation base being disposed within the gas flow director.

2. The system as claimed in claim 1 further comprising a quantity of dry ice positioned within the cavity of the insulation base.

3. The system as claimed in claim 1 further comprising a product box for receiving the payload of temperature-sensitive materials.

4. The system as claimed in claim 1 wherein the insulation base comprises a bottom and a plurality of sides and wherein the gas flow director covers substantially all of the bottom and the plurality of sides of the insulation base.

5. The system as claimed in claim 4 wherein the insulation base is 5-sided and comprises a bottom vacuum insulated panel and four side vacuum insulated panels, the four side vacuum insulated panels positioned on top of the bottom vacuum insulated panel.

6. The system as claimed in claim 4 wherein the gas flow director does not cover any of the open top of the insulation base.

7. The system as claimed in claim 4 wherein the gas flow director covers a portion, but not an entirety, of the open top of the insulation base.

8. The system as claimed in claim 7 wherein the first opening of the gas flow director is defined at least in part by a lip of the receptacle extending inwardly over the open top of the insulation base along at least one side thereof.

9. The system as claimed in claim 8 wherein the lip of the receptacle extends inwardly by at least 1 inch.

10. The system as claimed in claim 8 wherein the lip of the receptacle extends inwardly by about 4-5 inches.

11. The system as claimed in claim 8 wherein the first opening of the gas flow director is defined at least in part by a lip of the receptacle extending inwardly over the open top of the insulation base along all sides thereof.

12. The system as claimed in claim 11 wherein the first opening of the gas flow director is substantially centered relative to the open top of the insulation base.

13. The system as claimed in claim 11 wherein the first opening of the gas flow director is offset relative to the open top of the insulation base.

14. The system as claimed in claim 1 wherein the first opening is at least 2-3 inches wide.

15. The system as claimed in claim 1 wherein the gas flow director further comprises a second opening, the second opening being located along a side of the receptacle.

16. The system as claimed in claim 1 wherein the receptacle comprises a flexible bag.

17. The system as claimed in claim 16 wherein the flexible bag comprises a minimally breathable polymer film or sheet.

18. The system as claimed in claim 17 wherein the minimally breathable polymer film or sheet comprises a material selected from the group of a high density polyethylene, a polypropylene, and a polyamide/polyethylene composite.

19. The system as claimed in claim 16 wherein the receptacle further comprises a sheet shaped to define the first opening, the sheet being coupled to the flexible bag.

20. The system as claimed in claim 1 wherein the first opening is adjustable in size.

21. The system as claimed in claim 1 wherein the gas flow director further comprises a drawstring mechanism for adjusting the size of the first opening.

22. The system as claimed in claim 1 further comprising an insulation lid, the insulation lid being removably positionable over the open top of the insulation base.

23. The system as claimed in claim 22 wherein the first opening of the gas flow director is positioned below the insulation lid when the insulation lid is positioned over the insulation base.

24. The system as claimed in claim 22 wherein the first opening of the gas flow director is positioned over the insulation lid when the insulation lid is positioned over the insulation base.

25. The system as claimed in claim 1 wherein the first opening is at least 2-3 inches wide.

26. A system for storing and/or transporting a payload of temperature-sensitive materials, the system comprising:

(a) an insulation base, the insulation base comprising a plurality of pieces joined together at one or more interfaces to define a cavity for receiving the payload of temperature-sensitive materials, the insulation base having an open top;

(b) an insulation lid, the insulation lid being removably mounted over the insulation base to cover the cavity;

(c) a quantity of dry ice positioned within the cavity of the insulation base;

(d) an outer box, the insulation base being disposed within the outer box; and (e) a gas flow director, the gas flow director reducing the egress of gas from the cavity of the insulation base through the one or more interfaces, the gas flow director comprising a receptacle having a first opening, the first opening being located at a top end of the receptacle and being positioned between the open top of the insulation base and the insulation lid, the gas flow director being disposed within the outer box, the insulation base being disposed within the gas flow director.

27. The system as claimed in claim 26 wherein the insulation base is 5-sided and comprises a bottom vacuum insulated panel and four side vacuum insulated panels, the four side vacuum insulated panels positioned on top of the bottom vacuum insulated panel.

28. The system as claimed in claim 27 wherein the receptacle comprises a flexible bag.

29. The system as claimed in claim 28 wherein the first opening is adjustable in size.

30. A method for storing and/or transporting a payload of temperature-sensitive materials, the method comprising:

(a) providing a shipper, the shipper comprising an insulation base, the insulation base comprising a plurality of pieces joined together at one or more interfaces to define a cavity for receiving the payload of temperature-sensitive materials, the insulation base having an open top;

an outer box, the insulation base being disposed within the outer box; and a gas flow director, the gas flow director reducing the egress of gas from the cavity of the insulation base through the one or more interfaces, the gas flow director comprising a receptacle having a first opening, the first opening being located at a top end of the receptacle, the gas flow director being disposed within the outer box, the insulation base being disposed within the gas flow director;

(b) loading a payload into the cavity of the insulation base; and (c) loading a quantity of dry ice into the cavity of the insulation base.

* * * * *